US012297065B2

(12) United States Patent
Kenjo

(10) Patent No.: US 12,297,065 B2
(45) Date of Patent: May 13, 2025

(54) IMAGE FORMING SYSTEM, POST-PROCESSING APPARATUS AND BINDING DEVICE

(71) Applicant: MAX CO., LTD., Tokyo (JP)

(72) Inventor: Tatsuya Kenjo, Tokyo (JP)

(73) Assignee: Max Co., Ltd., Tokyo (JP)

( * ) Notice: Subject to any disclaimer, the term of this patent is extended or adjusted under 35 U.S.C. 154(b) by 114 days.

(21) Appl. No.: 18/229,629

(22) Filed: Aug. 2, 2023

(65) Prior Publication Data

US 2024/0043235 A1 Feb. 8, 2024

(30) Foreign Application Priority Data

Aug. 4, 2022 (JP) ..... 2022-124540

(51) Int. Cl.
*B27F 7/21* (2006.01)
*B65H 37/04* (2006.01)

(52) U.S. Cl.
CPC ... *B65H 37/04* (2013.01); *B65H 2301/42212* (2013.01); *B65H 2301/51611* (2013.01); *B65H 2403/51* (2013.01); *B65H 2801/03* (2013.01); *B65H 2801/24* (2013.01)

(58) Field of Classification Search
CPC ..... B42B 4/00; B65H 37/04; B65H 2301/42212; B65H 2301/51611; B65H 2403/51; B65H 2601/25; B65H 2801/27; B27F 7/21
USPC ..... 270/58.07, 58.08
See application file for complete search history.

(56) References Cited

U.S. PATENT DOCUMENTS

| | | | | |
|---|---|---|---|---|
| 5,702,047 | A | 12/1997 | Yoshie | |
| 8,905,285 | B2 * | 12/2014 | Sugihara | B27F 7/21 227/129 |
| 11,731,308 | B2 * | 8/2023 | Shimamura | B27F 7/36 227/155 |
| 11,787,029 | B2 * | 10/2023 | Chigira | B27F 7/36 227/131 |
| 12,103,153 | B2 * | 10/2024 | Nagata | B25C 5/025 |

FOREIGN PATENT DOCUMENTS

| | | |
|---|---|---|
| EP | 0729813 A1 | 9/1996 |
| JP | 2932438 B2 | 8/1999 |

OTHER PUBLICATIONS

Feb. 15, 2024—(EP) Extended Search Report—App 23189237.3.

* cited by examiner

*Primary Examiner* — Leslie A Nicholson, III
(74) *Attorney, Agent, or Firm* — Banner & Witcoff, Ltd.

(57) ABSTRACT

An image forming system including an image forming apparatus configured to form an image on a sheet, a post-processing apparatus comprising a binding device configured to bind the sheet output from the image forming apparatus, and a control unit configured to control the binding device. The binding device is capable of executing binding processing via a staple forming process of forming a staple and moving the staple toward a striking-out position and a staple striking-out process of striking out the staple at the striking-out position. The control unit is configured to control the binding device to repeat multiple times the staple forming process without undergoing the staple striking-out process.

13 Claims, 34 Drawing Sheets

IMAGE FORMING SYSTEM, POST-PROCESSING APPARATUS AND BINDING DEVICE

CROSS-REFERENCE TO RELATED APPLICATIONS

The present application claims priority from Japanese Patent Application No. 2022-124540 filed on Aug. 4, 2022, the entire content of which is incorporated herein by reference.

TECHNICAL FIELD

The present disclosure relates to an image forming system including an image forming apparatus that forms an image on a sheet, and a post-processing apparatus having a binding device that binds a sheet output from the image forming apparatus, a post-processing apparatus and a binding device.

BACKGROUND ART

An electric stapler attached to an image forming apparatus, a post-processing apparatus or the like includes a forming plate for forming a straight staple needle into a U-shape, a driver plate for striking out the U-shaped staple needle into a sheet, and a feeding unit for delivering the staple needle toward a position below the forming plate and the driver plate. The staple needles are connected in a sheet shape and accommodated in the electric stapler as sheet-like staples.

The forming plate is located upstream of the driver plate in a feeding direction of the sheet-like staples, and the forming plate and the driver plate are configured to be actuated in conjunction with each other. Therefore, when the forming plate and the driver plate are operated in a state where the staple needles are located at positions below the forming plate and the driver plate, respectively, the staple needles at the position below the forming plate are each formed in a U-shape, and the staple needles at the position below the driver plate are each struck out.

In the meantime, there is a case where when the electric stapler is activated, a leading staple of the sheet-shaped staples is not located below the forming plate or the driver plate. For this reason, it is necessary to perform a staple initial setting of moving (feeding) a leading staple to a position below the driver plate by repeating an operation until the leading staple is located below the driver plate, i.e., until the leading staple is in a state where it can be actually struck out.

However, a so-called idle striking is performed by the driver plate while the staple initial setting is performed, i.e., until the staple is located below the driver plate, and resultantly, a problem occurs in which an idle striking mark is left on a sheet.

For example, disclosed is an automatic binding preparation mechanism for an electric stapler where a detection means detects whether a leading staple is located below a driver plate, and a sheet to be bound is kept on standby without being set until it is detected by the detection means that the leading staple is located below the driver plate, i.e., until actual striking-out is possible (Japanese Patent No. 2932438). According to this mechanism, since the sheet to be bound is not set until the staple initial setting is completed, no idle striking mark is left on the sheet to be bound.

SUMMARY OF INVENTION

However, in the mechanism described in Japanese Patent No. 2932438, the sheet should stand by without being set until actual striking-out is possible, and when it is intended to perform staple initial setting in a state where the sheet is set, an idle striking mark is left on the sheet.

Therefore, an object of the present disclosure is to provide an image forming system and a post-processing apparatus including a binding device configured such that no idle striking mark is left on a sheet even when a staple initial setting is performed in a state where the sheet is set, and a binding device.

An image forming system according to the present disclosure includes an image forming apparatus configured to form an image on a sheet, a post-processing apparatus including a binding device configured to bind the sheet output from the image forming apparatus, and a control unit configured to control the binding device. The binding device is capable of executing binding processing via a staple forming process of forming a staple and moving the staple toward a striking-out position and a staple striking-out process of striking out the staple at the striking-out position, and the control unit is configured to control the binding device to repeat multiple times the staple forming process without undergoing the staple striking-out process.

Since the binding device is controlled by the control unit to repeat multiple times the staple forming process without undergoing the staple striking-out process, during this control, the staple is moved (fed) toward the striking-out position, but a staple striking-out operation is not performed. For this reason, even when the staple initial setting is performed in a state where the sheet is set in the device in advance, an idle striking mark due to the striking-out operation is not left on the sheet.

In addition, a post-processing apparatus according to the present disclosure includes a binding device configured to bind a sheet output from an image forming apparatus configured to form an image on the sheet, and a control unit configured to control the binding device. The binding device is capable of executing binding processing via a staple forming process of forming a staple and moving the staple toward a striking-out position and a staple striking-out process of striking out the staple at the striking-out position, and the control unit is configured to control the binding device to repeat multiple times the staple forming process without undergoing the staple striking-out process.

Since the binding device attached to the image forming system or post-processing apparatus described above is controlled by the control unit to repeat multiple times the staple forming process without undergoing the staple striking-out process, during this control, the staple is moved (fed) toward the striking-out position, but the staple striking-out operation is not performed. For this reason, even when the sheet has already been set, an idle striking mark due to the striking-out operation is not left on the sheet.

A binding device according to the present disclosure includes a staple forming unit configured to form a staple and to move the staple toward a striking-out position, a staple striking-out unit configured to strike out the staple at the striking-out position, and a cam configured to actuate the staple forming unit and the staple striking-out unit. The cam has a first cam surface for actuating the staple forming unit and the staple striking-out unit, and a second cam surface for actuating the staple forming unit by bypassing all or part of actuation of the staple striking-out unit by the first cam surface.

When actuating the staple forming unit or the staple striking-out unit by the cam, the binding device uses the first cam surface and thus can execute a binding operation by forming of a staple and striking-out of the formed staple, while the binding device uses the second cam surface and thus can execute the staple initial setting of actuating the staple forming unit by bypassing all or part of the staple striking-out operation. When executing the staple initial setting operation by using the second cam surface, the staple forming unit is actuated by bypassing all or part of the staple striking-out operation, and accordingly, the staple can be fed without leaving an idle striking mark due to the striking-out operation on the sheet.

A binding device according to the present disclosure includes a plurality of staple forming units each configured to form a staple and to move the staple toward a striking-out position, a plurality of staple striking-out units each configured to strike out the staple at the striking-out position, a plurality of cams configured to actuate the plurality of staple forming units and the plurality of staple striking-out units, and a single motor configured to drive the cams, in which each of the cams has a first cam surface for actuating the staple forming unit and the staple striking-out unit, and a second cam surface for actuating the staple forming unit by bypassing all or part of actuation of the staple striking-out unit by the first cam surface.

In order to bind a plurality of places of sheet at once, a binding device that actuates a plurality of staple forming units and staple striking-out units with one motor is sometimes used. In such a binding device, there is a case in which positions of staples of the plurality of staple forming units are not matched, such as after replacement of the staples. For example, the staple of one staple forming unit is located at the forming position or striking-out position, while the staple of another staple forming unit is not located at the forming position or striking-out position. In such a case, in the present binding device, since the staple feeding is repeated multiple times (e.g., 2 to 3 times) without striking out the staple after the staple forming operation, the positions of the staples of the plurality of staple forming units can be matched (the staple initial setting processing can be completed) without leaving an idle striking mark on the sheet.

Even when the sheet is set in the binding device in advance, the staple initial setting can be performed without leaving an idle striking mark on the sheet.

DESCRIPTION OF EMBODIMENTS

Hereinafter, embodiments of an image forming system, a post-processing apparatus, and a binding device of the present invention will be described with reference to the drawings.

<Example of Embodiment of Image Forming System and Post-Processing Apparatus>

Figure 1:
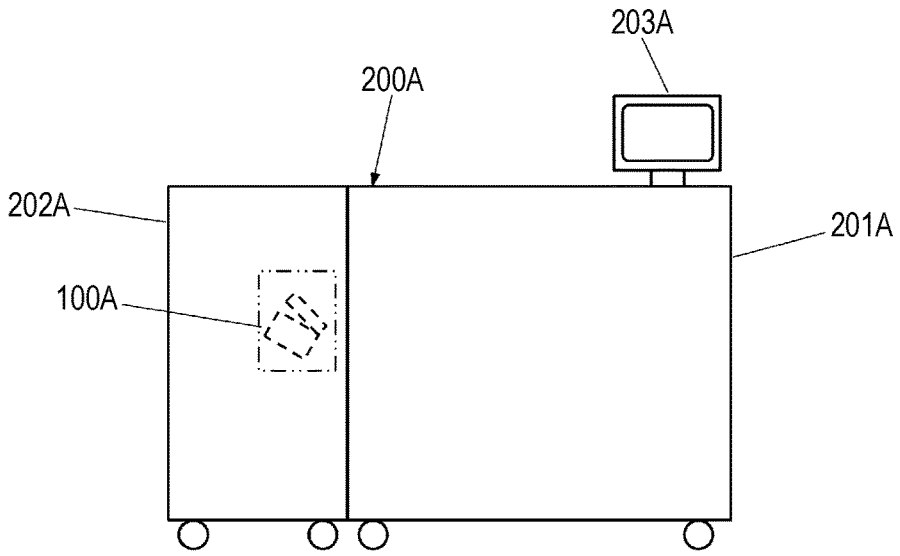
FIG. 1 is a configuration diagram showing an example of an embodiment of an image forming system and a post-processing apparatus.
Figure 2:
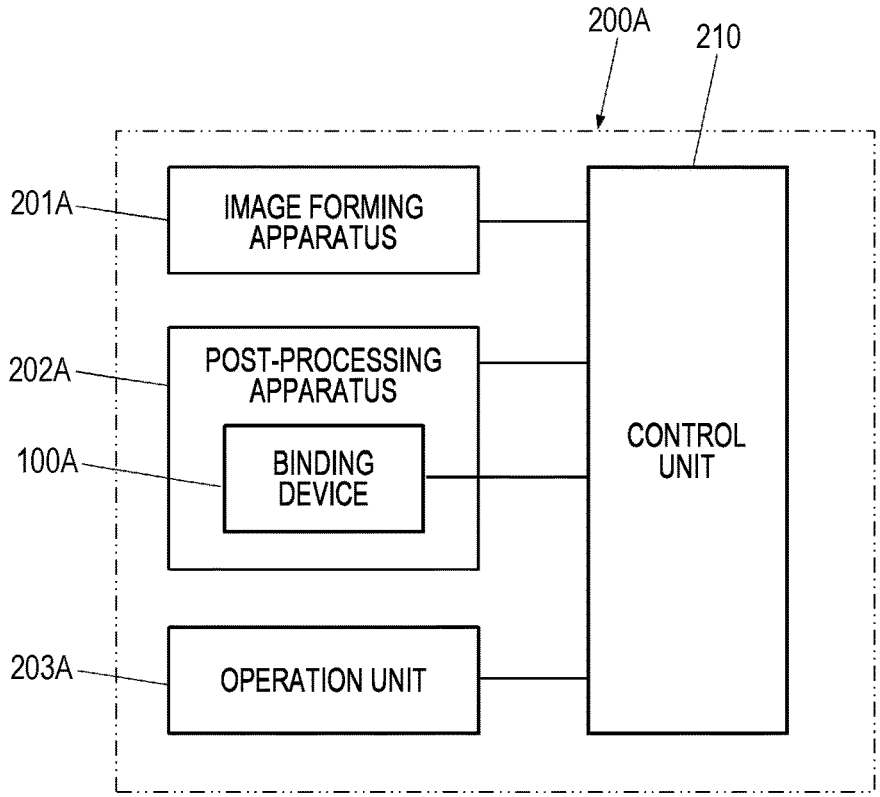
FIG. 2 is a block diagram showing an example of the embodiment of the image forming system and the post-processing apparatus.
Figure 3:
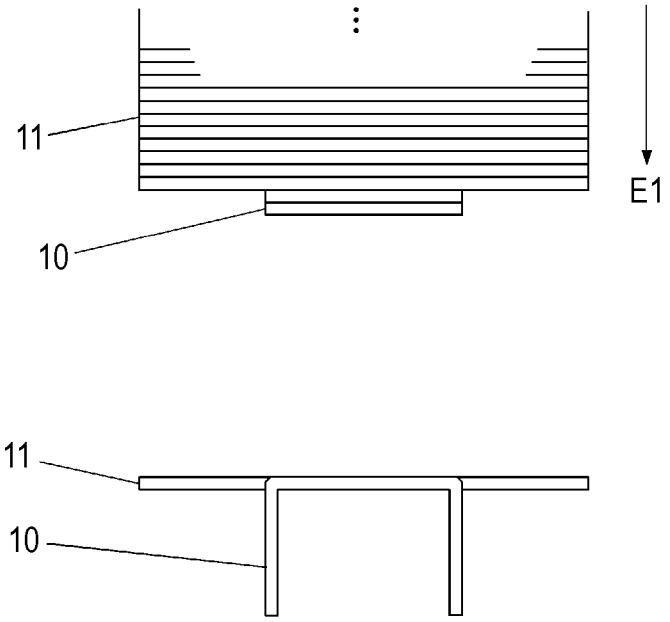
FIG. 3 illustrates an example of a staple.

FIG. 1 is a configuration diagram showing an example of an embodiment of an image forming system and a post-processing apparatus, FIG. 2 is a block diagram showing an example of the embodiment of the image forming system and the post-processing apparatus, and FIG. 3 illustrates an example of a staple.

In addition, FIGS. 4A to 4G illustrate an example of an operation of the image forming system and post-processing apparatus, showing a second mode (initial setting mode) in which staple initial setting processing of repeating multiple times a staple forming process without undergoing a staple striking-out process is executed. Further, FIGS. 5A to 5C illustrate an example of an operation of the image forming system and post-processing apparatus, showing a first mode (striking-out mode) in which binding processing is executed via the staple forming process and the staple striking-out process.

An image forming system 200A includes an image forming apparatus 201A that forms an image on a sheet, a post-processing apparatus 202A having a binding device 100A that binds the sheet output from the image forming apparatus 201A with a staple 10, and an operation unit 203A that receives a person's operation. In addition, the image forming system 200A includes a control unit 210 that controls the binding device 100A. Note that the control unit 210 may be provided in any of the image forming apparatus 201A, the post-processing apparatus 202A, and the binding device 100A. However, in the present example, an example in which the control unit is provided in the post-processing apparatus 202A will be described. The control unit 210 may include a processor such as a central processing unit (CPU), a micro processing unit (MPU), or the like.

As shown in FIG. 3, the staple 10 has a straight shape before forming. A plurality of staples 10 are aligned in a width direction and are detachably connected by an adhesive or the like to form a sheet shape (the plurality of staples 10 in the form of a sheet are hereinafter referred to as "sheet staples 11"), and the sheet staples 11 are stacked and accommodated in the binding device 100A. The lowermost sheet staple 11 of the stacked sheet staples 11 is fed in a direction of an arrow E1, which is a connecting direction of the staples 10, and is formed into a U-shape.

As shown in FIGS. 4A to 4F, the binding device 100A can execute binding processing via a staple forming process of forming a staple 10 and moving the staple toward a striking-out position P2 and a staple striking-out process of striking out the staple 10 at the striking-out position P2, and includes a staple forming unit 2A that forms the staple 10 and moves the staple toward the striking-out position P2 in the staple forming process, and a staple striking-out unit 2B that strikes out the staple 10 at the striking-out position P2 in the staple striking-out process. The staple forming unit 2A includes a forming plate 20 that forms the staple 10 at a forming position P1, a staple feeding unit 50 that moves the formed staple 10 toward the striking-out position P2, and moves a next unformed staple 10 (sheet staple 11) toward the forming position P1. In addition, the staple striking-out unit 2B includes a driver plate 21 that strikes out the staple 10 at the striking-out position P2.

The staple feeding unit 50 includes a claw portion 51 that is engaged with the staple and a link portion 52 that is pushed by the forming plate 20 in an operation in which the forming plate 20 is moved in a direction of an arrow F10, and is urged in a direction of an arrow E1, which is a feeding direction of the staple 10, by a spring 53.

In an operation in which the forming plate 20 is moved in the direction of the arrow F10 for forming the staple 10, the link portion 52 is pushed by the forming plate 20, so that the staple feeding unit 50 is moved in a direction of an arrow E2 while compressing the spring 53. In an operation in which the forming plate 20 is moved in a direction of an arrow F20 away from the staple 10, the link portion 52 is released from being pushed by the forming plate 20, so that the staple feeding unit 50 is moved in the direction of the arrow E1 by the force of the spring 53.

Thereby, in the operations in which the forming plate 20 are moved in the directions of the arrows F10 and F20, the staple feeding unit 50 reciprocates in the directions of the arrows E1 and the arrow E2, and feeds the staple 10 engaged with the claw portion 51 in the direction of the arrow E1.

Note that the staple feeding unit 50 is not limited to operating in conjunction with the forming plate 20, and may be configured to operate in conjunction with the driver plate 21, or may have a drive source independent of the forming plate 20 and the driver plate 21.

Figure 4A:
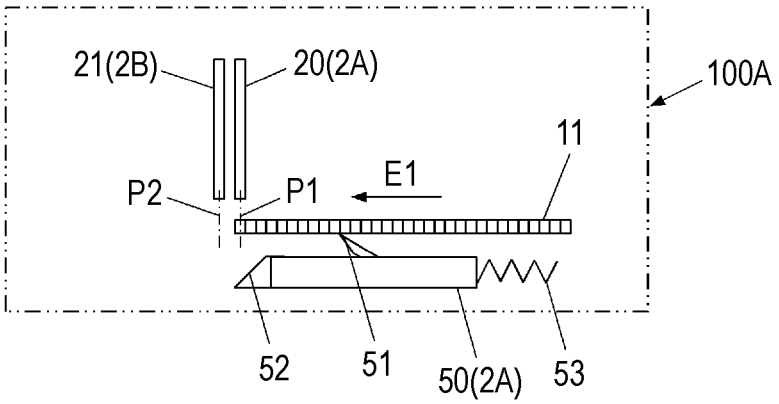
FIG. 4A illustrates an example of an operation of the image forming system and post-processing apparatus.
Figure 4B:
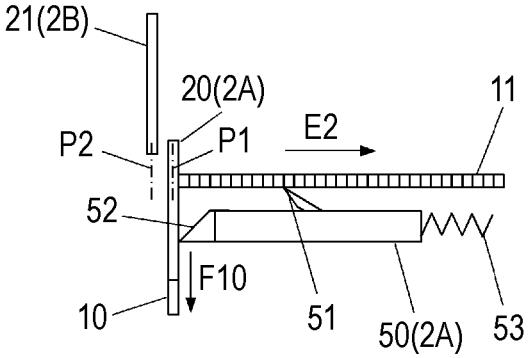
FIG. 4B illustrates the example of the operation of the image forming system and post-processing apparatus.
Figure 5A:
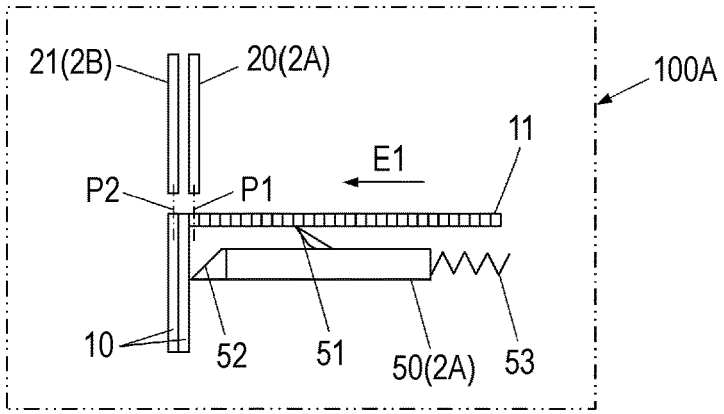
FIG. 5A illustrates an example of an operation of the image forming system and post-processing apparatus.
Figure 5B:
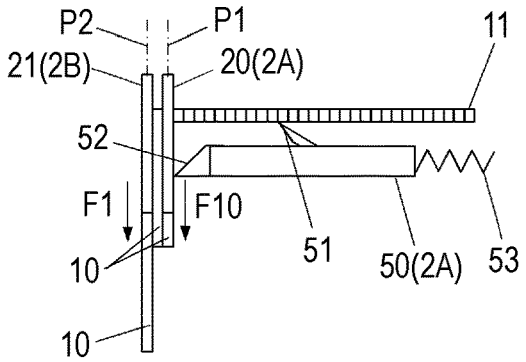
FIG. 5B illustrates the example of the operation of the image forming system and post-processing apparatus.
Figure 5C:
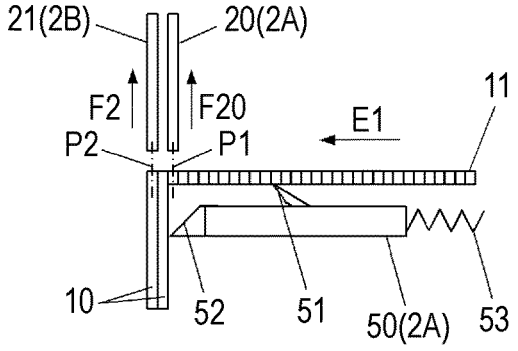
FIG. 5C illustrates the example of the operation of the image forming system and post-processing apparatus.

Before the staple initial setting processing is completed, the forming plate 20 and the driver plate 21 are each located at a standby position (FIG. 4A). From this state, when the forming plate 20 is moved in the direction of the arrow F10, the staple 10 at the forming position P1 is formed and the link portion 52 is pushed by the forming plate 20, so that the staple feeding unit 50 is moved in the direction of the arrow E2 while compressing the spring 53 (FIG. 4B).

Figure 4C:
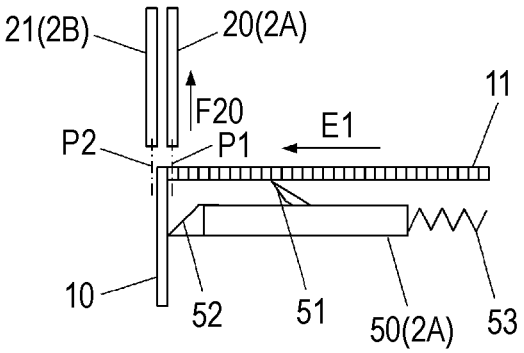
FIG. 4C illustrates the example of the operation of the image forming system and post-processing apparatus.

After moving the forming plate 20 in the direction of the arrow F10, when the forming plate 20 is moved in the direction of the arrow F20, the link portion 52 is released from being pushed by the forming plate 20, so that the staple feeding unit 50 is moved in the direction of the arrow E1 by the force of the spring 53. Thereby, the staple 10 is fed in the direction of the arrow E1 toward the striking-out position P2 (FIG. 4C).

Below, control of repeating the staple forming process multiple times without undergoing the staple striking-out process will be described.

Figure 6:
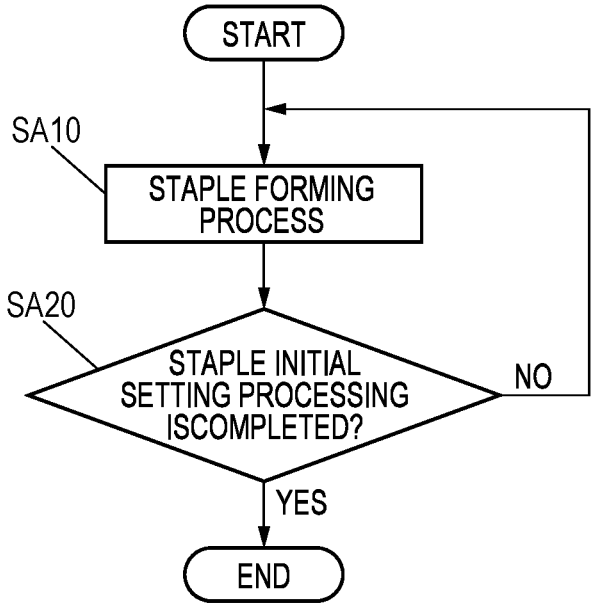
FIG. 6 is a flowchart showing an example of an operation of a control unit.

FIG. 6 shows an example of an operation of the control unit 210. In the standby state (FIG. 4A) in which the staple initial setting processing has not been completed and the forming plate 20 and the driver plate 21 have been moved to their respective standby positions, the control unit 210 causes the binding apparatus 100A to execute the staple forming process, in step SA10 of FIG. 6 (FIG. 4B). At this time, by regulating actuation of the driver plate 21 or regulating an amount of actuation thereof, the staple striking-out process is not undergone (not executed), so the driver plate 21 is not actuated and only the forming plate 20 is moved in the direction of the arrow F10, as shown in FIG. 4B. Thereby, the staple 10 at the forming position P1 is formed. When the amount of actuation of the driver plate 21 is regulated, the driver plate 21 is moved in the direction of the arrow F10 within a range in which it does not come into contact with the staple 10.

In addition, as the link portion 52 is pushed by the forming plate 20 in the operation in which the forming plate 20 is moved in the direction of the arrow F10 for forming the staple the staple feeding unit 50 is moved in the direction of the arrow E2 while compressing the spring 53.

After moving the forming plate 20 in the direction of the arrow F10, the control unit 210 moves the forming plate 20 in the direction of the arrow F20, as shown in FIG. 4C. As the forming plate 20 is moved in the direction of the arrow F20 away from the formed staple 10, the link portion 52 is released from being pushed by the forming plate 20 and is moved in the direction of the arrow E1 by the force of the spring 53. Thereby, the staple 10 is fed in the direction of the arrow E1 toward the striking-out position P2. The first staple forming process is executed by the above operations in FIGS. 4B and 4C.

Figure 4D:
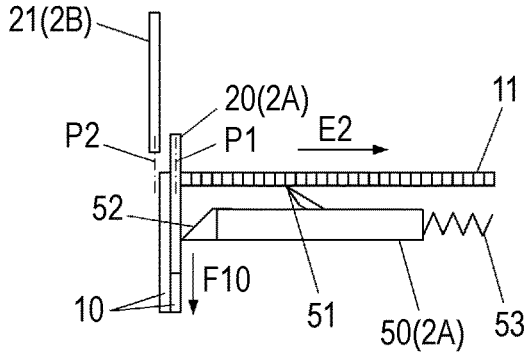
FIG. 4D illustrates the example of the operation of the image forming system and post-processing apparatus.

The control unit 210 determines in step SA20 of FIG. 6 whether the staple initial setting processing has ended. If it is determined that the staple initial setting processing has not ended, the control unit returns to step SA10 and again causes the binding device 100A to execute the staple forming process without undergoing the staple striking-out process. That is, the control unit 210 sets a predetermined state of regulating the actuation of the driver plate 21 or regulating the amount of actuation, and moves the forming plate 20 in the direction of the arrow F10 as shown in FIG. 4D. Thereby, the next staple 10 moved to the staple forming position P1 in the previous staple forming process is formed.

Figure 4E:
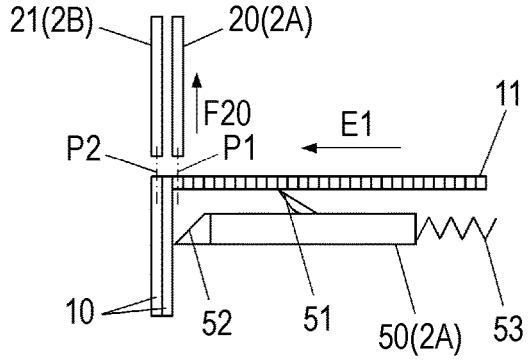
FIG. 4E illustrates the example of the operation of the image forming system and post-processing apparatus.

After moving the forming plate 20 in the direction of the arrow F10, the control unit 210 moves the forming plate 20 in the direction of the arrow F20, as shown in FIG. 4E. Thereby, the staple 10 is fed in the direction of the arrow E1 toward the striking-out position P2. The second staple forming process is executed by the above operations in FIGS. 4D and 4E.

In the present example, since the formed staple 10 is moved to the striking-out position P2 by the second staple forming process, the staple 10 formed in the staple forming process is reliably moved to the striking-out position P2 by performing the staple forming process two times or more.

Figure 4F:
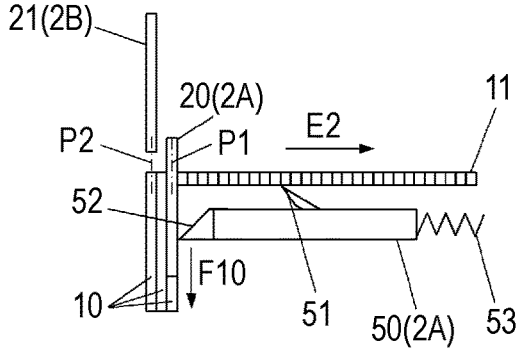
FIG. 4F illustrates the example of the operation of the image forming system and post-processing apparatus.

After the second staple forming process is executed, the control unit 210 proceeds to step SA20, but determines that the staple initial setting processing has not yet ended, and executes the staple forming process again in step SA10. The control unit 210 moves the forming plate 20 in the direction of the arrow F10, as shown in FIG. 4F, in order to execute the third and subsequent staple forming processes without undergoing the staple striking-out process. Thereby, the next staple 10 moved to the staple forming position P1 in the previous staple forming process is formed.

Figure 4G:
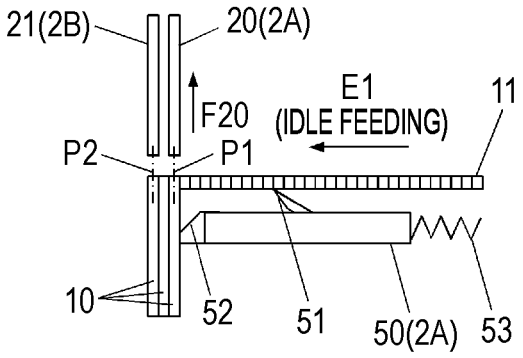
FIG. 4G illustrates the example of the operation of the image forming system and post-processing apparatus.

After moving the forming plate 20 in the direction of the arrow F10, the control unit 210 moves the forming plate 20 in the direction of the arrow F20, as shown in FIG. 4G. In the third and subsequent staple forming processes, the staple 10 formed in the staple forming process has been already moved to the striking-out position P2. In the present example, since a staple stopper (not shown) for limiting feeding of the staple is provided at an end of the striking-out position P2, a so-called idle feeding is made in which even when the staple feeding unit 50 is moved in the direction of the arrow E1, the staple 10 is not fed. The second and subsequent staple forming processes are executed by the above operations in FIGS. 4F and 4G. In addition, the binding device 100A does not have a means for detecting the staple at the striking-out position P2.

In the present example, after the staple forming process has been executed three times, the control unit 210 determines in step SA20 of FIG. 6 that the staple initial setting processing has ended, and ends the processing. As described above, the control unit 210 controls the binding device 100A to repeat the staple forming process multiple times without undergoing the staple striking-out process. Note that in the staple forming process that is executed without undergoing the staple striking-out process, the driver plate 21 may be moved within a range in which it does not come into contact with the staple 10. According to the image forming system 200A, the staple forming process can be repeated multiple times without involving the striking-out of the staple 10, i.e., without performing so-called idle striking. In addition, even after the leading staple 10 is moved to the striking-out position P2, the staple forming process can be executed without involving the striking out of the leading staple 10. Therefore, there is no need to set the sheet in order to prevent the leading staple 10 from being struck out without a sheet, and the staple initial setting processing can be executed by executing the staple forming process in a state where a sheet is not set. Further, even when a sheet is set, an idle striking mark due to idle striking is not left on the sheet. Therefore, regardless of the presence or absence of a sheet, it is possible to execute the staple initial setting processing by executing the staple forming process. Further, it is possible to perform the initial setting for the staple 10 without the need for the binding device 100A to have a means for detecting that the staple 10 is present at the striking-out position P2. Further, as compared with a case where the idle striking is performed (the driver plate 21 is moved to the striking-out position), it is possible to shorten an operating time required for the staple initial setting.

The control unit 210 controls the binding device 100A to be able to switch a first mode (striking-out mode) in which the binding processing is performed via the staple forming process and the staple striking-out process, and a second mode (initial setting mode) in which the staple initial setting processing is executed by repeating multiple times the staple forming process without undergoing the staple striking-out process.

First, the first mode will be described.

FIG. 5A shows a standby state in which the forming plate 20 and the driver plate 21 are respectively located at standby positions. In the control of executing the binding processing via the staple forming process and the staple striking-out process, i.e., in the first mode, the forming plate 20 and the driver plate 21 are actuated in conjunction with each other. For this reason, part or all of the staple striking-out process and the staple forming process are executed overlapped on a time-series basis.

In the first mode, the control unit 210 moves the forming plate 20 in the direction of the arrow F10 and moves the driver plate 21 in the direction of the arrow F1, as shown in FIG. 5B. Thereby, the staple 10 at the forming position P1 is formed by the forming plate 20, and the staple 10 at the striking-out position P2 is struck out by the driver plate 21.

After moving the forming plate 20 in the direction of the arrow F10 and moving the driver plate 21 in the direction of the arrow F1, as shown in FIG. 5C, when the forming plate 20 is moved in the direction of the arrow F20 and the driver plate 21 is moved in the direction of the arrow F2, the link portion 52 is released from being pushed by the forming plate 20, and is moved in the direction of the arrow E1 by the force of the spring 53. Thereby, the staple 10 is fed in the direction of the arrow E1.

Next, the second mode will be described. In the second mode, the operations of FIGS. 4A to 4G and the control of FIG. 6 described above are performed, and the binding device 100A is controlled to repeat the staple forming process multiple times without undergoing the staple striking-out process by the control unit 210.

FIGS. 7A to 7F illustrates a binding device 100A2 of another embodiment, in the second mode.

The binding device 100A2 is different from the binding device 100A in that the forming plate 20 and the driver plate 21 are integrally configured. The binding device 100A2 includes a driver forming plate 20B in which the forming plate 20 and the driver plate 21 are integrally configured, and switches an amount of actuation of the driver forming plate 20B in the first mode and the second mode.

Figure 7A:
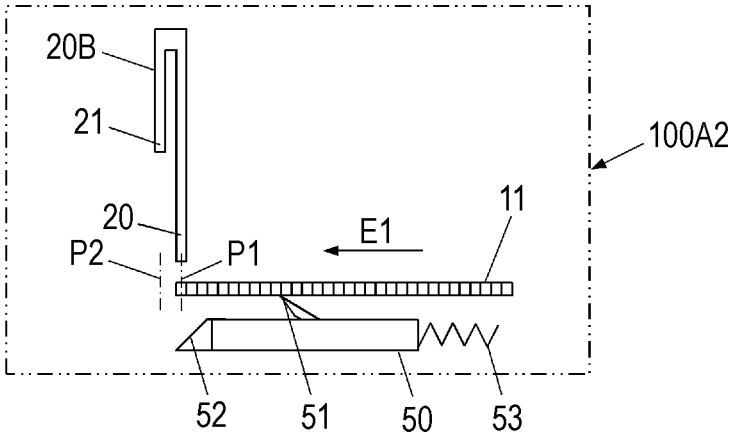
FIG. 7A illustrates an example of an operation of the image forming system and post-processing apparatus having a binding device of another embodiment.
Figure 7B:
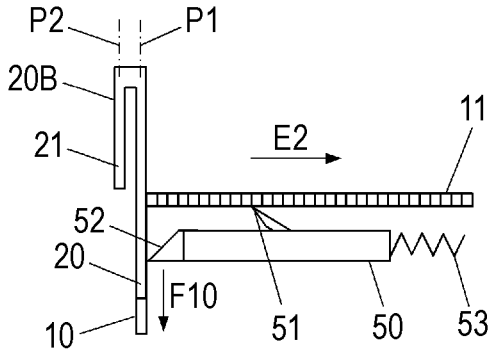
FIG. 7B illustrates the example of the operation of the image forming system and post-processing apparatus having the binding device of another embodiment.

FIG. 7A shows a standby state in which the staple initial setting processing has not been completed and the forming plate 20 and the driver plate 21 have been moved to their respective standby positions. In order to execute the staple forming process without undergoing the staple striking-out process, the control unit 210 sets a predetermined state of regulating an amount of actuation of the driver forming plate 20B, and moves the driver forming plate 20B in the direction of the arrow F10, as shown in FIG. 7B. Thereby, the staple 10 at the forming position P1 is formed by the forming plate 20. The driver forming plate 20B is moved within a range in which the driver plate 21 does not come into contact with the staple 10 when the staple 10 is present at the striking-out position P2 in the staple forming process. For this reason, the staple forming process is executed without undergoing the staple striking-out process.

In addition, as the link portion 52 is pushed by the forming plate 20 in the operation in which the driver forming plate 20B is moved in the direction of the arrow F10 for forming the staple 10, the staple feeding unit 50 is moved in the direction of the arrow E2 while compressing the spring 53.

Figure 7C:
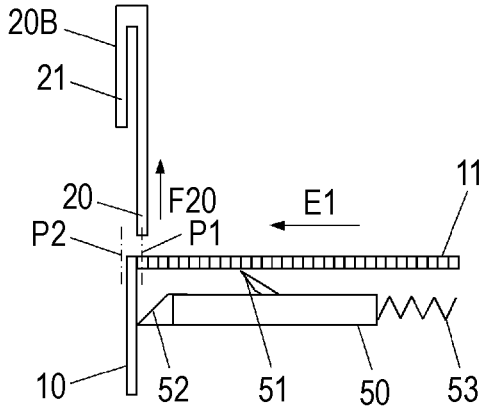
FIG. 7C illustrates the example of the operation of the image forming system and post-processing apparatus having the binding device of another embodiment.

After moving the driver forming plate 20B in the direction of the arrow F10, as shown in FIG. 7C, the driver forming plate 20B is moved in the direction of the arrow F20. In an operation in which the forming plate 20 is moved in the direction of the arrow F20 away from the formed staple 10, the link portion 52 is released from being pushed by the forming plate 20, so that the staple feeding unit 50 is moved in the direction of the arrow E1 by the force of the spring 53. Thereby, the staple 10 is fed in the direction of the arrow E1 toward the striking-out position P2. The first staple forming process is executed by the above operations in FIGS. 7B and 7C.

Figure 7D:
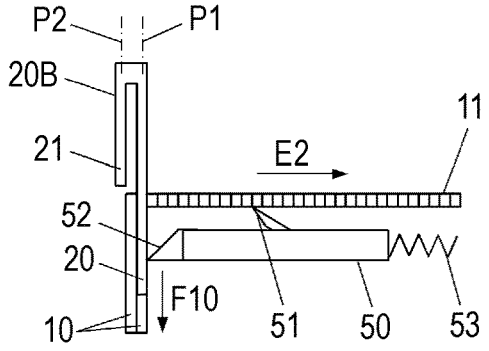
FIG. 7D illustrates the example of the operation of the image forming system and post-processing apparatus having the binding device of another embodiment.

When it is determined based on the number of executions of the staple forming process or the like that the staple initial setting processing has not ended, in order to repeat the staple forming process without undergoing the staple striking-out process, the control unit 210 sets a predetermined state of regulating an amount of actuation of the driver forming plate 20B, and as shown in FIG. 7D, moves the driver forming plate 20B in the direction of the arrow F10. Thereby, the next staple 10 moved to the staple forming position P1 in the previous staple forming process is formed.

Figure 7E:
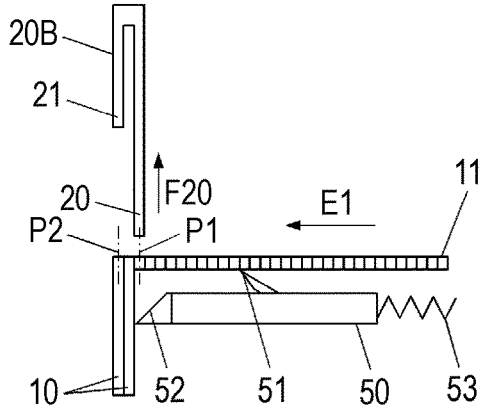
FIG. 7E illustrates the example of the operation of the image forming system and post-processing apparatus having the binding device of another embodiment.

After moving the driver forming plate 20B in the direction of the arrow F10, as shown in FIG. 7E, the driver forming plate 20B is moved in the direction of the arrow F20. Thereby, the staple 10 is fed in the direction of the arrow E1 toward the striking-out position P2. The second staple forming process is executed by the above operations in FIGS. 7D and 7E.

In the present example, in the second staple forming process, the staple 10 formed in the staple forming process is moved to the striking-out position P2. For this reason, by executing the staple forming process two times or more, the staple 10 formed in the staple forming process is reliably moved to the striking-out position P2.

Although the staple 10 is moved to the striking-out position P2 by the two staple forming processes, the third and subsequent staple forming processes may be executed without undergoing the staple striking-out process. When it is determined that the staple forming process has been performed predetermined n times or more, the control unit 210 determines that the staple initial setting processing has ended, and ends the processing.

Figure 7F:
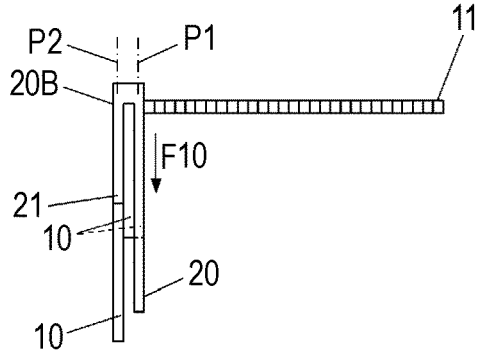
FIG. 7F illustrates the example of the operation of the image forming system and post-processing apparatus having the binding device of another embodiment.

Note that, in the binding device 100A2, during execution of the first mode in which the binding processing is executed via the staple forming process and the staple striking-out process, the control unit sets a predetermined state in which the amount of actuation of the driver forming plate 20B is not regulated, and as shown in FIG. 7F, moves the driver forming plate 20B in the direction of the arrow F10. Thereby, the next staple 10 moved to the staple forming position P1 in the previous staple forming process is formed. In addition, since the staple 10 is present at the striking-out position P2, the formed staple 10 is struck out by the driver plate 21. The control unit 210 controls the first mode and the second mode to be switchable, i.e., to be selectively executable. Thereby, since the initial setting and striking-out of the staple 10 can be used separately, it becomes possible to execute each mode according to the state of the binding device 100A2 (100A).

<Example of Embodiment of Binding Device>

Figure 8:
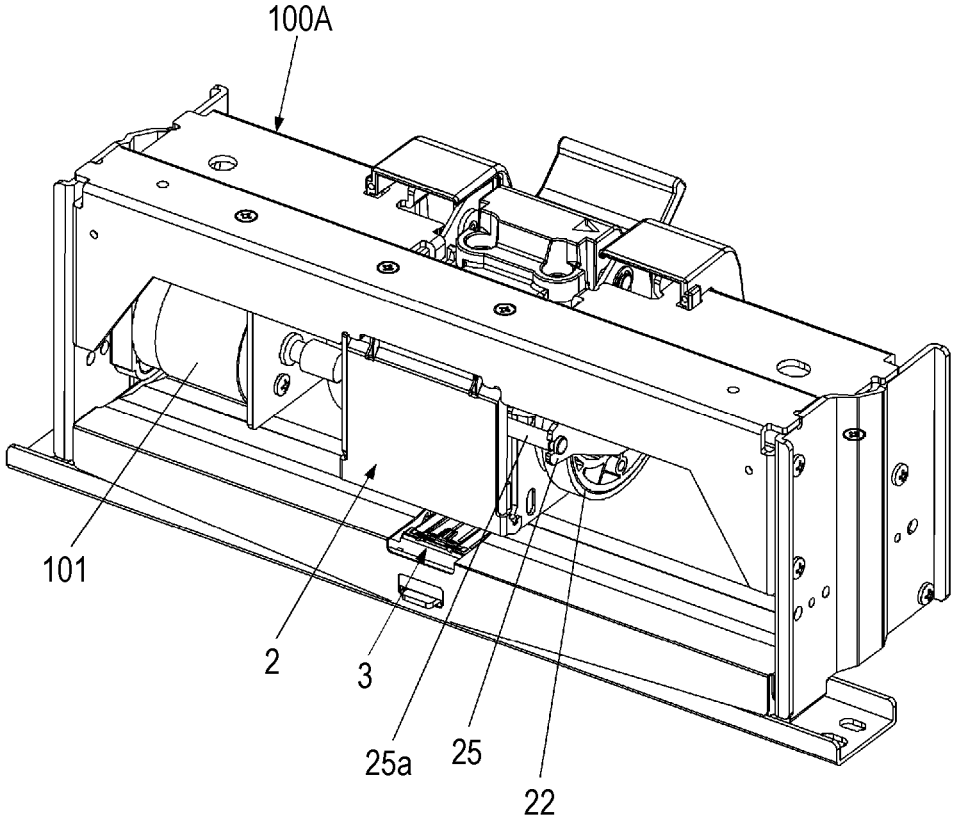
FIG. 8 is a perspective view showing an example of an embodiment of a binding device.
Figure 9A:
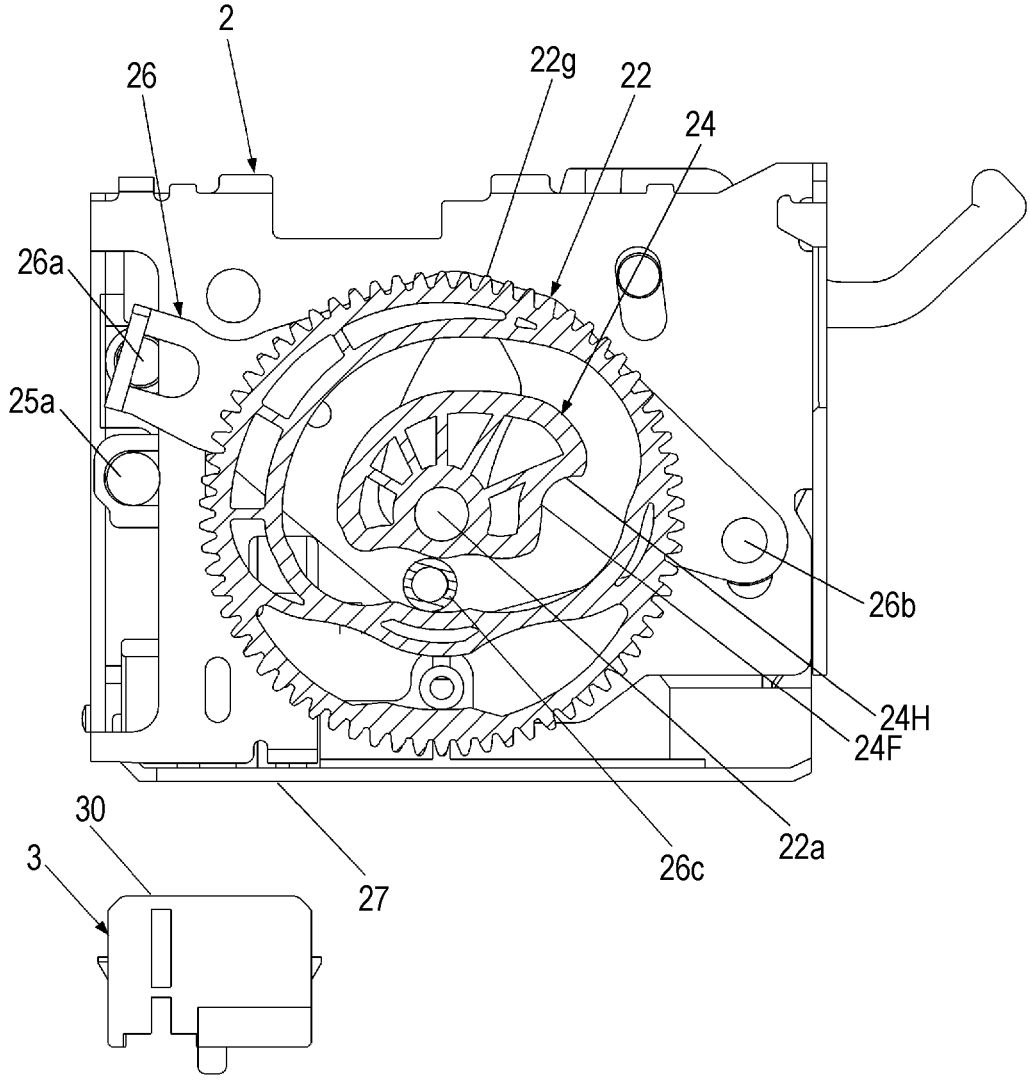
FIG. 9A is a side cross-sectional view showing an example of an embodiment of a forming striking-out unit and a bending unit.
Figure 9B:
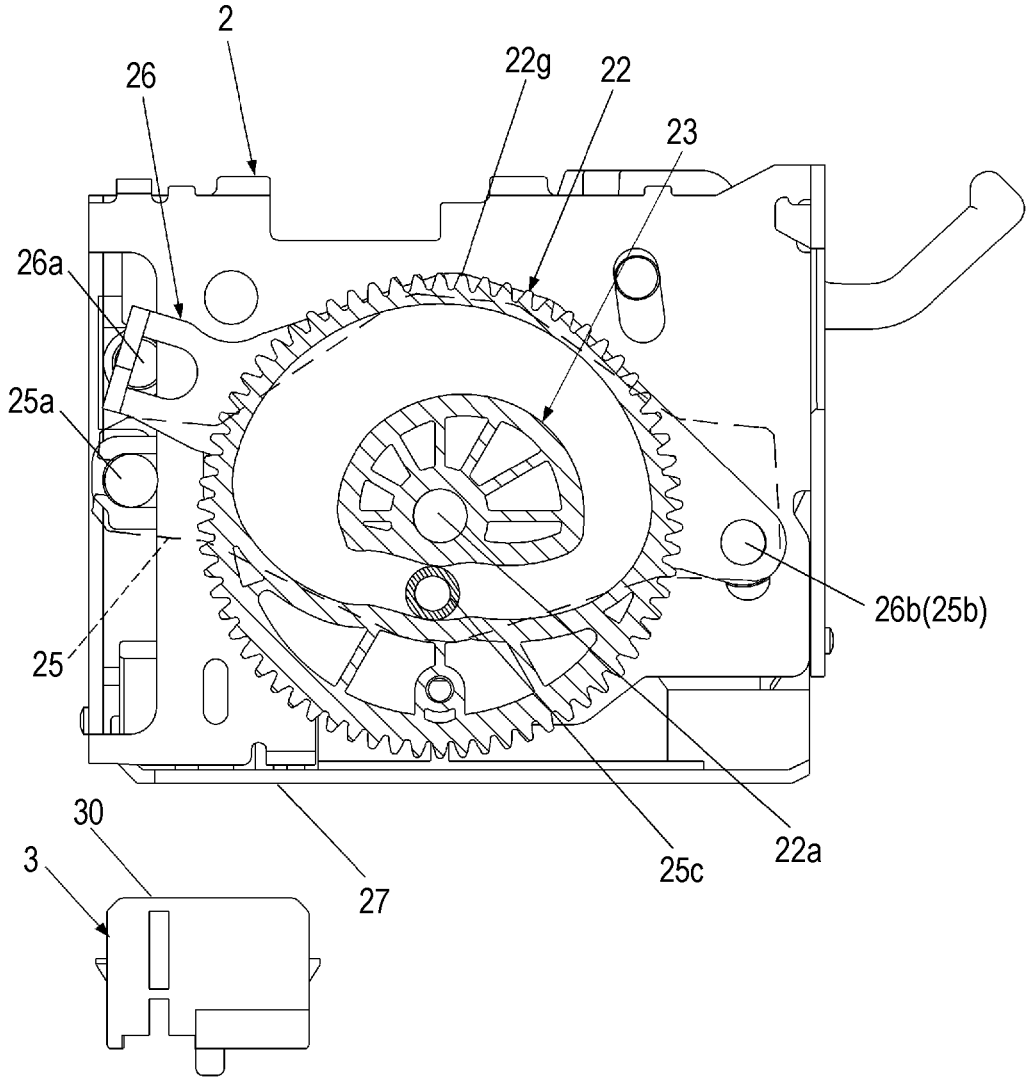
FIG. 9B is a side cross-sectional view showing the example of the embodiment of the forming striking-out unit and the bending unit.
Figure 10:
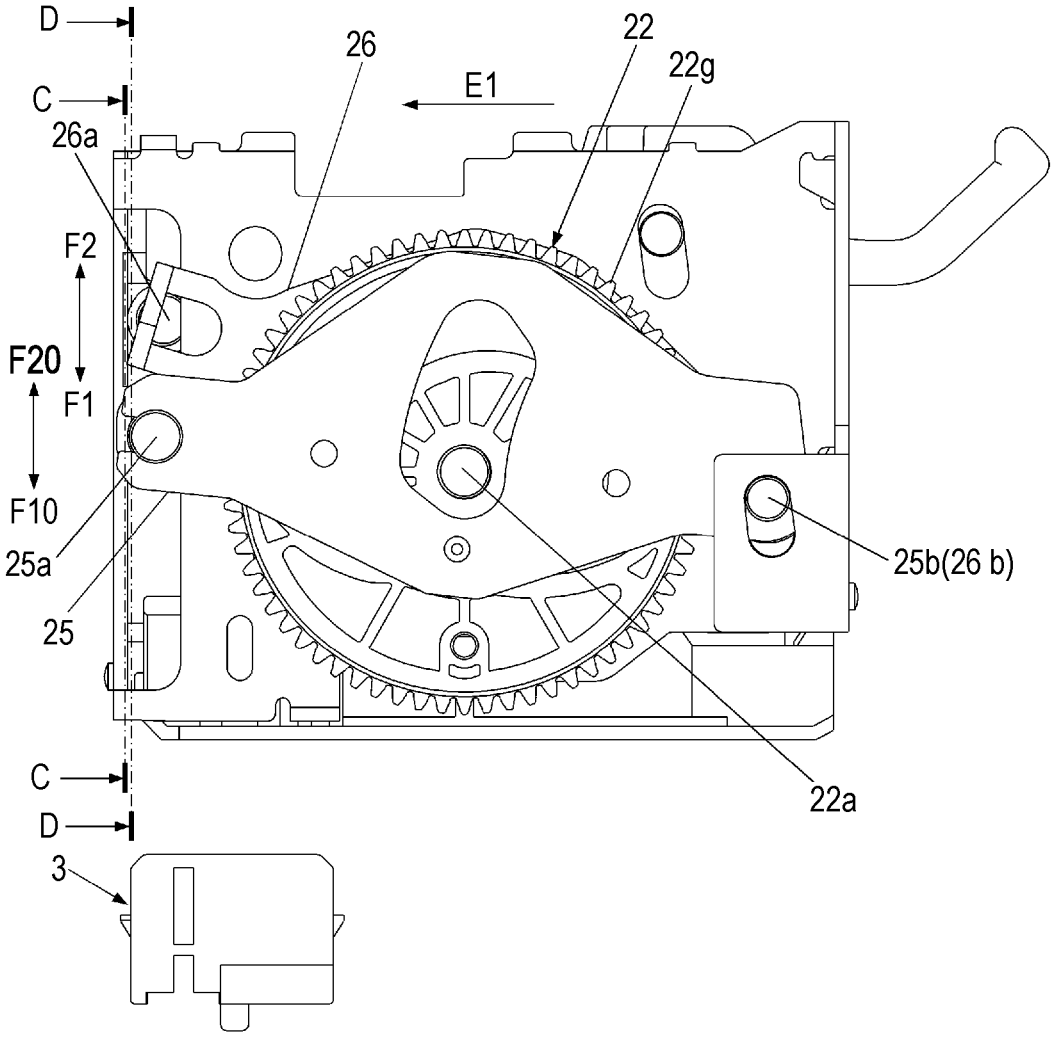
FIG. 10 is a side view showing the example of the embodiment of the forming striking-out unit and the bending unit.
Figure 11A:
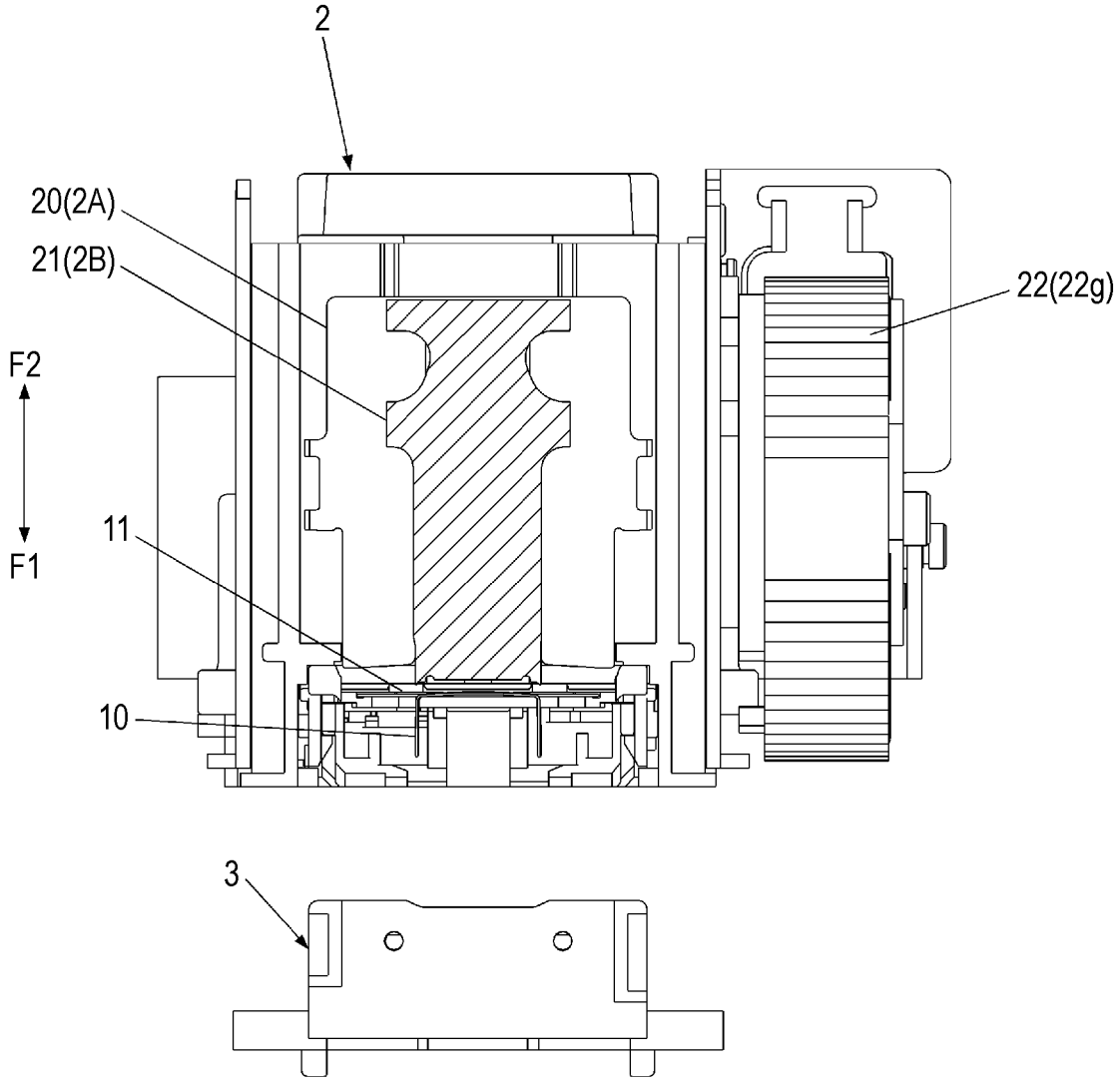
FIG. 11A is a front cross-sectional view showing the example of the embodiment of the forming striking-out unit and the bending unit.
Figure 11B:
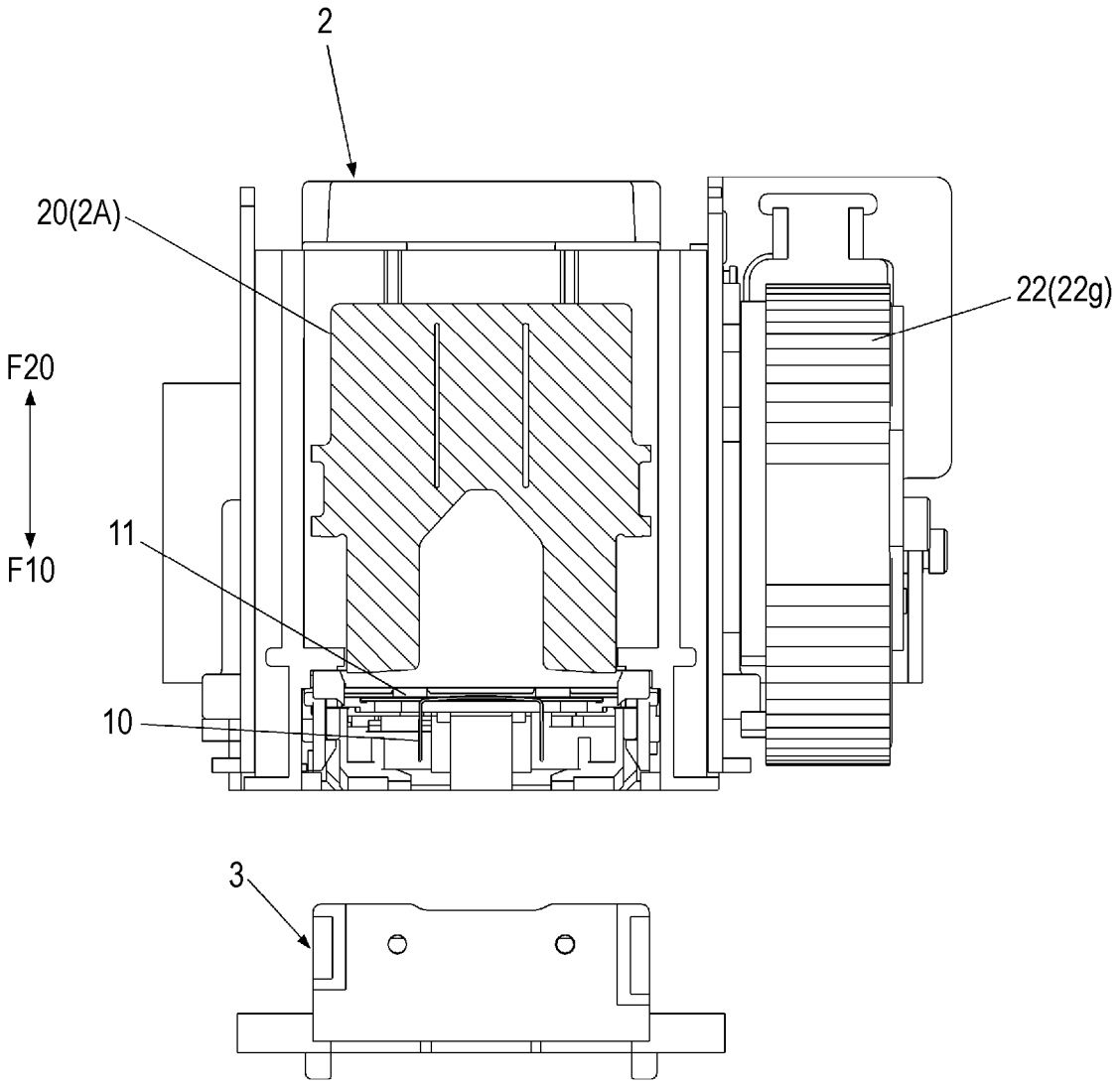
FIG. 11B is a front cross-sectional view showing the example of the embodiment of the forming striking-out unit and the bending unit.
Figure 12:
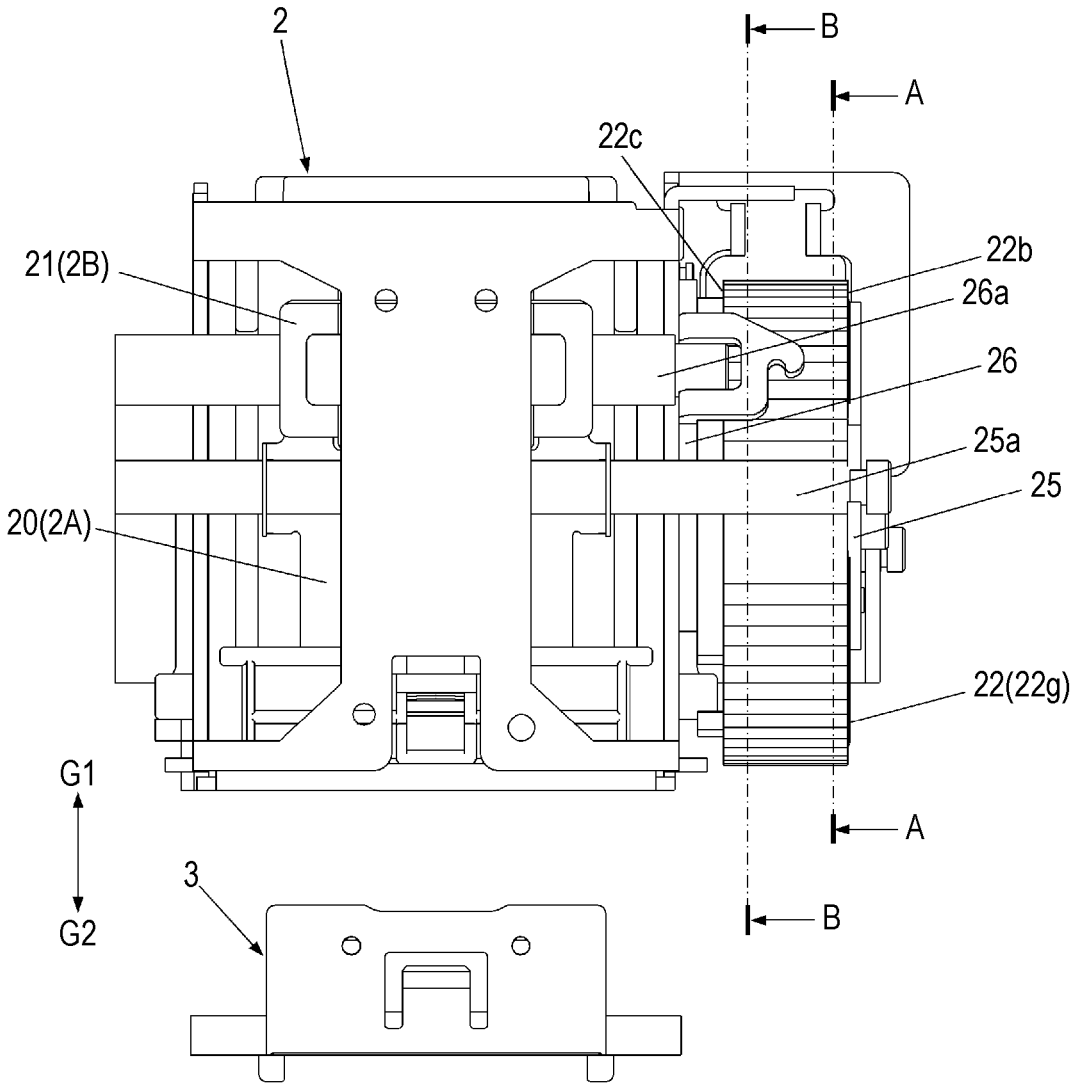
FIG. 12 is a front view showing the example of the embodiment of the forming striking-out unit and the bending unit.

FIG. 8 is a perspective view showing an example of an embodiment of a binding device, FIGS. 9A and 9B are side cross-sectional views showing an example of an embodiment of a forming striking-out unit and a bending unit, and FIG. 10 is a side view showing the example of the embodiment of the forming striking-out unit and the bending unit. In addition, FIGS. 11A and 11B are front cross-sectional views showing the example of the embodiment of the forming striking-out unit and the bending unit, and FIG. 12 is a front view showing the example of the embodiment of the forming striking-out unit and the bending unit. FIG. 9A shows a driver cam in a cross-sectional view taken along a line B-B in FIG. 12. FIG. 9B shows a forming cam in a cross-sectional view taken along a line A-A in FIG. 12. FIG. 11A shows a driver plate in a cross-sectional view taken along a line C-C in FIG. 10. FIG. 11B shows a forming plate in a cross-sectional view taken along a line D-D in FIG. 10.

Next, an example of a binding device adapted to be able to execute a staple forming process without undergoing a staple striking-out process will be described.

The binding device 100A includes a forming striking-out unit 2 for forming the staple 10 and striking out the formed staple 10, a bending unit 3 for bending a staple leg of the staple 10 struck out by the forming striking-out unit 2, and a motor 101 for driving both or one of the forming striking-out unit 2 and the bending unit 3. The motor 101 is controlled by the control unit 210.

The forming striking-out unit 2 includes a staple forming unit 2A that forms a staple 10 and feeds (moves) the formed staple 10 toward the striking-out position in the staple forming process, a staple striking-out unit 2B that strikes out the staple 10 at the striking-out position in the staple striking-out process, and a cam (actuation unit) 22 that actuates the staple forming unit 2A and the staple striking-out unit 2B. In the present example, the cam 22 is a rotatable flat plate cam.

The staple forming unit 2A includes a forming plate 20 for forming the staple 10 and a staple feeding unit 50 for feeding (moving) the staple 10 toward the striking-out position (refer to FIG. 4A, and the like). The staple striking-out unit 2B includes a driver plate 21 for striking out the staple 10 formed by the forming plate 20. The cam 22 is configured to be displaceable (rotatable in the present example), and the staple forming unit 2A and the staple striking-out unit 2B can be actuated by displacing (rotating) the cam 22.

The forming plate 20 and the driver plate 21 are arranged along a feeding (moving) direction of the staple 10, and the forming plate 20 is located upstream of the driver plate 21 in the feeding direction of the staple 10. For this reason, the staple 10 formed by the forming plate 20 is moved to the striking-out position by the staple feeding unit 50 and struck out by the driver plate 21.

The forming plate 20 and the driver plate 21 are configured to be actuated in conjunction with each other. In the present example, when the previous staple 10 is struck out by the driver plate 21, the next staple 10 (a staple to be struck out next or subsequently) is formed by the forming plate 20 simultaneously or almost simultaneously.

The forming striking-out unit 2 is configured so that the driver plate 21 is actuated to strike out the staple 10, which is a striking-out target, and the forming plate 20 is actuated to form the staple 10, which is a forming target. The staple 10 formed first by the forming plate is moved to the striking-out position by the driver plate 21 and then struck out by the driver plate 21. At this time, since the forming plate 20 is actuated in conjunction with the driver plate 21, when the previous staple is struck out by the driver plate 21, the next staple 10 (a staple 10 to be struck out next or subsequently) is formed by the forming plate 20 simultaneously or almost simultaneously.

In addition, the forming striking-out unit 2 is configured such that the striking-out of the staple 10 is not performed by regulating the presence or absence of actuation of the driver plate 21 or the amount of actuation, the forming plate 20 is actuated to form the staple 10, which is a forming target, and the formed staple 10 is moved to the striking-out position by the driver plate 21.

Below, a driving mechanism of the driver plate 21 and the forming plate 20, which enables switching between the first mode and the second mode, will be described.

The driver plate 21 is provided on one end portion side of the forming striking-out unit 2 along the feed direction of the sheet staples 11 indicated by the arrow E1. The driver plate 21 is supported to be movable in the direction of the arrow F1 and the direction of the arrow F2 opposite to the direction of the arrow F1, which are substantially orthogonal to the feeding direction of the sheet staples 11 indicated by the arrow E1. The driver plate 21 strikes out the staple 10 on a distal end side in the moving direction denoted with the arrow F1.

The forming plate 20 is provided on an upstream side of the driver plate 21 in the feeding direction of the sheet staples 11 indicated by the arrow E1. In the present example, the forming plate 20 is provided spaced apart from the driver plate 21 with a gap corresponding to one width of the staple 10 in the width direction. The forming plate 20 is supported to be movable independently of the driver plate 21 in the direction of the arrow F10 and the direction of the arrow F20 opposite to the direction of the arrow F10, which are substantially orthogonal to the feeding direction of the sheet staples 11 indicated by the arrow E1. The forming plate 20 forms the staple 10 on a distal end side in the moving direction denoted with the arrow F10.

As described above, the forming plate 20 is provided on the upstream side of the driver plate 21 in the feeding direction of the sheet staples 11, so that it is located upstream of the staple 10 to be struck out by the driver plate 21 and forms the staple 10 to be struck out next or subsequently.

The cam 22 is provided on a gear 22*g*. The gear 22*g* is configured by a spur gear that rotates with a shaft 22*a* as a fulcrum, one surface along an axial direction serves as a forming cam surface 22*b*, and the other surface serves as a driver cam surface 22*c*.

A forming cam 23 for actuating the forming plate 20 is formed on the forming cam surface 22*b*. The forming cam 23 is configured by a cam whose distance from the shaft 22*a* varies, and includes a groove of a predetermined shape extending along a rotation direction of the cam 22 (gear 22*g*) with the shaft 22*a* as a fulcrum.

In addition, a driver cam 24 for actuating the driver plate 21 is formed on the driver cam surface 22*c*. The driver cam 24 is configured by a cam whose distance from the shaft 22*a* varies, and includes a groove of a predetermined shape extending along the rotation direction of the cam 22 (gear 22*g*) with the shaft 22*a* as a fulcrum.

The forming striking-out unit 2 includes a forming link 25 that actuates the forming plate 20, following the shape of the forming cam 23. The forming link 25 has a shape extending along the feeding direction of the sheet staples 11 indicated by the arrow E1, has one end portion connected to the forming plate 20 by a connecting portion 25*a*, and the other end portion rotatably supported by the forming striking-out unit 2 with a shaft 25*b* as a fulcrum, and is provided facing the forming cam surface 22*b* of the cam 22.

The connecting portion 25*a* is, for example, a circular cylinder or cylindrical shaft, and connects the forming plate 20 and the forming link 25 rotatably. In addition, an axial direction of rotation of the forming plate 20 and the forming link 25 by the connecting portion 25*a* is parallel to an axial direction of rotation of the forming link 25 by the shaft 25*b*. Thereby, with the rotating operation of the forming link 25 with the shaft 25*b* as a fulcrum, the forming plate 20 can be moved in the direction of the arrow F10 and in the direction of the arrow F20.

The forming link 25 includes a forming follower 25*c* that actuates the forming link 25, following the shape of the forming cam 23.

The forming follower 25*c* is a circular cylinder or cylindrical member that has a diameter fitting into (the groove of) the forming cam 23 and is movable following the forming cam 23, and is attached to the forming link 25 facing the forming cam surface 22*b*. The forming follower 25*c* is located between the connecting portion 25*a* and the shaft 25*b*, protrudes in a direction of the forming cam 23, and enters the forming cam 23.

In the forming cam 23, a distance from the shaft 22*a* of the cam 22 (gear 22*g*) varies in a predetermined pattern along the rotation direction of the cam 22 (gear 22*g*) with the shaft 22*a* as a fulcrum. Thereby, when the cam 22 rotates, the forming follower 25*c* follows the forming cam 23, so that the forming link 25 rotates with the shaft 25*b* as a fulcrum. With a rotating operation of the forming link 25 with the shaft 25*b* as a support point, the forming plate 20 is moved in the direction of the arrow F10 for forming the staple 10 and in the direction of the arrow F20 away from the formed staples 10, according to a rotational angle of the cam 22 (gear 22*g*).

The forming striking-out unit 2 includes a driver link 26 that actuates the driver plate 21, following the shape of the driver cam 24. The driver link 26 has a shape extending along the feeding direction of the sheet staples 11 indicated by the arrow E1, has one end portion connected to the driver plate 21 by a connecting portion 26*a*, and the other end portion rotatably supported by the forming striking-out unit 2 with a shaft 26*b* as a fulcrum, and is provided facing the driver cam surface 22*c* of the cam 22.

The connecting portion 26*a* is, for example, a circular cylinder or cylindrical shaft, and the driver plate 21 and the driver link 26 are rotatably connected by the connecting portion 26*a*. In addition, an axial direction of rotation of the driver plate 21 and the driver link 26 by the connecting portion 26*a* is parallel to an axial direction of rotation of the driver link 26 by the shaft 26*b*. Thereby, with the rotating operation of the driver link 26 with the shaft 26*b* as the fulcrum, the driver plate 21 can be moved in the direction of the arrow F1 and in the direction of the arrow F2.

The driver link 26 includes a driver follower 26*c* that actuates the driver link 26, following the shape of the driver cam 24.

The driver follower 26*c* is a circular cylinder or cylindrical member that has a diameter fitting into (the groove of) the driver cam 24 and is movable following the driver cam 24, and is provided on a surface of the driver link 26 facing the driver cam surface 22*c* of the cam 22 (gear 22*g*). The driver follower 26*c* is located between the connecting portion 26*a* and the shaft 26*b*, protrudes in a direction of the driver cam 24, and enters the driver cam 24.

In the driver cam 24, a distance from the shaft 22*a* of the cam 22 (gear 22*g*) varies in a predetermined pattern along the rotation direction of the cam 22 (gear 22*g*) with the shaft 22*a* as a fulcrum. Thereby, when the cam 22 (gear 22*g*) rotates, the driver follower 26*c* follows the driver cam 24, so that the driver link 26 rotates with the shaft 26*b* as a fulcrum.

With a rotating operation of the driver link 26 with the shaft 26*b* as a support point, the driver plate 21 is moved in the direction of the arrow F1 for striking out the staple 10 and in the direction of the arrow F2 away from the formed staple 10, according to the rotational angle of the cam 22 (gear 22*g*).

The forming striking-out unit 2 is provided with a clamping part 27 for striking out the staple 10 and sandwiching the sheet (bundle) at a part facing the bending unit 3. The bending unit 3 includes a clincher (not shown) for bending the staple 10, and a clamping part 30 for a sheet (bundle) formed at a part facing the forming striking-out unit 2.

In addition, the forming striking-out unit 2 and the bending unit 3 are configured such that a rotating operation of the cam 22 (gear 22*g*) is transmitted to a mechanism (not shown) and the forming striking-out unit 2 and the bending unit 3 are thus moved in a direction of an arrow G1 in which they relatively come close to each other and in a direction of an arrow G2 in which they become relatively distant from each other.

Thereby, with the rotating operation of the cam 22 (gear 22*g*), clamping and unclamping of the sheet (bundle) by the reciprocating movement of the forming striking-out unit 2, forming of the staple 10 by the reciprocating movement of the forming plate 20, and striking-out of the staple 10 by the reciprocating movement of the driver plate 21 are performed. By switching the rotation direction and rotational angle of the cam 22 (gear 22*g*), the first mode and the second mode, i.e., the striking-out mode and the initial setting mode are switched. That is, it is possible to selectively execute the number of execution times of the staple forming operation (process) that does not involve the staple striking-out operation (process), or whether to execute the striking-out mode, such as executing the striking-out mode after executing the initial setting mode. According to this binding device 100A, an idle striking mark due to idle striking is not left on the sheet. In addition, it is possible to perform the initial setting for the staple without the need to have a means for detecting that a staple is present at the striking-out position P2.

Figure 13A:
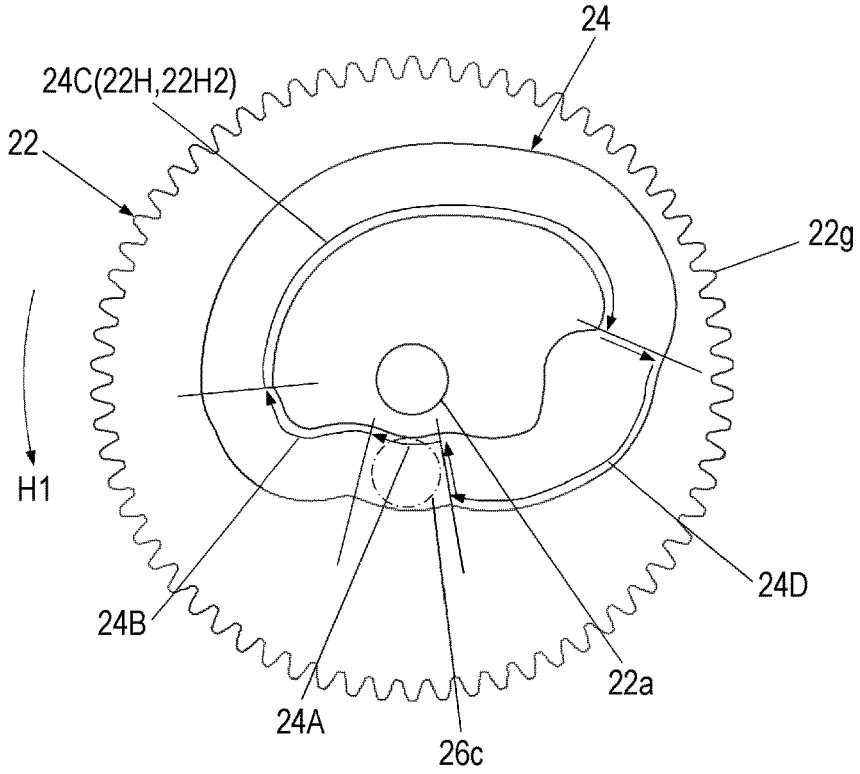
FIG. 13A illustrates an example of a function assigned to a driver cam in a striking-out mode.
Figure 13B:
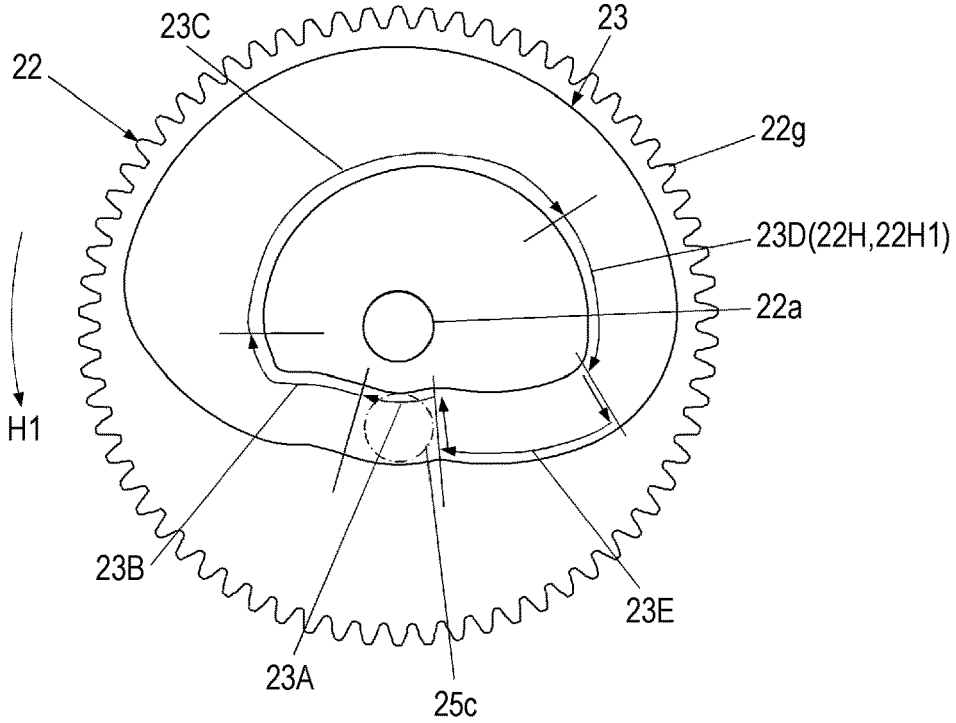
FIG. 13B illustrates an example of a function assigned to a forming cam in the striking-out mode.
Figure 13C:
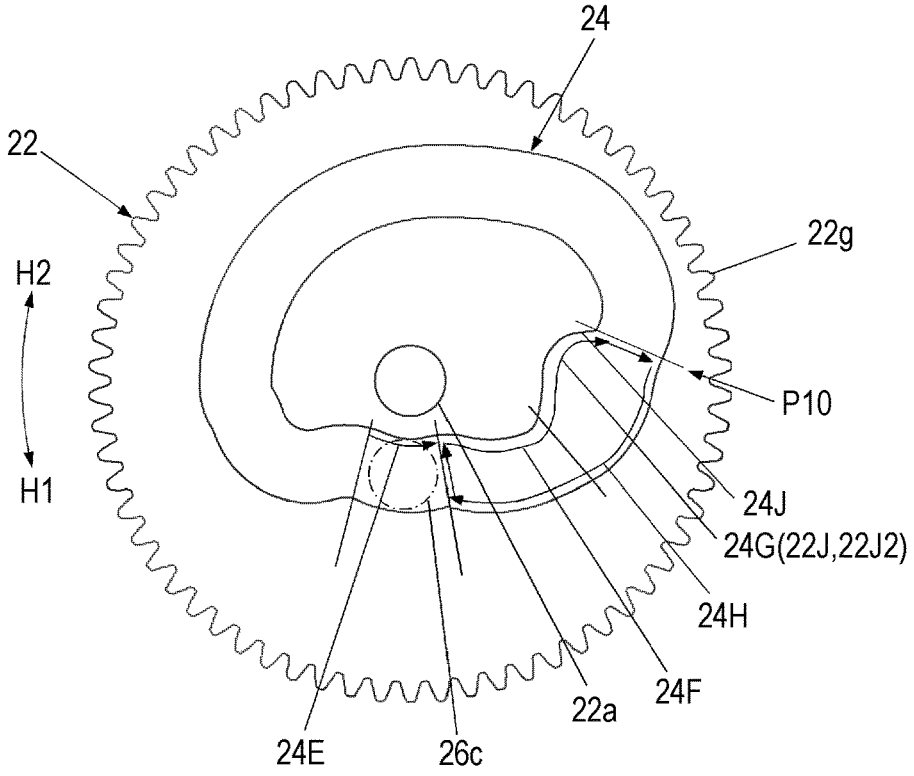
FIG. 13C illustrates an example of a function assigned to the driver cam in an initial setting mode.
Figure 13D:
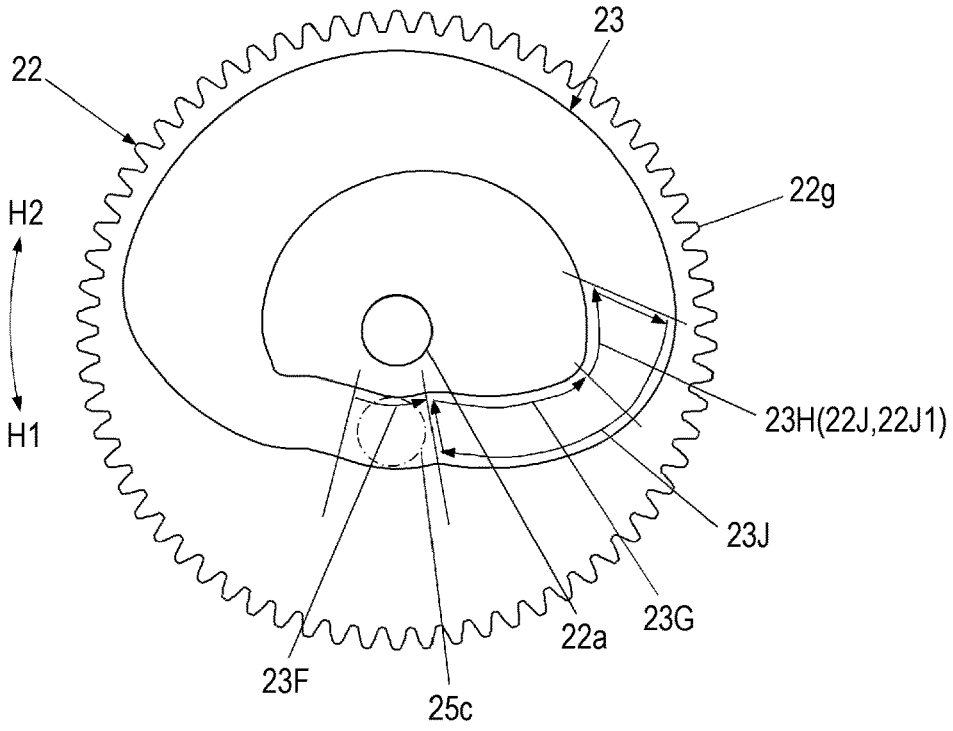
FIG. 13D illustrates an example of a function assigned to the forming cam in the initial setting mode.

FIG. 13A illustrates an example of a function assigned to the driver cam in the striking-out mode, and FIG. 13B illustrates an example of a function assigned to the forming cam in the striking-out mode. In addition, FIG. 13C illustrates an example of a function assigned to the driver cam in the initial setting mode, and FIG. 13D illustrates an example of a function assigned to the forming cam in the initial setting mode.

In the striking-out mode, by rotating the cam 22 (gear 22*g*) once in a forward direction denoted with an arrow H1, the clamping and unclamping operation of the sheet (bundle)

by the reciprocating movement of the forming striking-out unit 2, the forming operation of the staple 10 by the reciprocating movement of the forming plate 20, and the striking-out operation of the staple 10 by the reciprocating movement of the driver plate 21 are performed in conjunction. Note that although one revolution of the cam 22 (gear 22*g*) is assigned to the striking-out mode, the rotation range of the gear may be less than one revolution.

In the initial setting mode, by rotating the cam 22 (gear 22*g*) at a predetermined rotational angle in a reverse direction denoted with an arrow H2 and the forward direction denoted with the arrow H1, the clamping and unclamping operation by the reciprocating movement of the forming striking-out unit 2 and the forming operation of the staple 10 by the reciprocating movement of the forming plate 20 are performed in conjunction with each other without performing the striking-out operation of the staple 10.

In the striking-out mode, in an operation in which the cam 22 (gear 22*g*) is rotated in the forward direction denoted with the arrow H1, a contact surface (groove surface) of the driver cam 24 with the driver follower 26*c* functions as a home region 24A, a clamping region 24B, a striking-out region 24C, and a return region 24D along a rotation direction of the cam 22 (gear 22*g*) with the shaft 22*a* as a fulcrum, as shown in FIG. 13A.

In the striking-out mode, in the operation in which the cam 22 (gear 22*g*) is rotated in the forward direction denoted with the arrow H1, the driver follower 26*c* passes through the home region 24A, the clamping region 24B, and the striking-out region 24C in contact with an inner surface of the groove of the driver cam 24, i.e., a radially inner surface of the cam 22 (gear 22*g*). Thereafter, in the operation in which the cam 22 (gear 22*g*) is rotated in the forward direction denoted with the arrow H1, the driver follower 26*c* passes through the return region 24D in contact with an outer surface of the groove of the driver cam 24, i.e., a radially outer surface of the cam 22 (gear 22*g*).

In the striking-out mode, in the operation in which the cam 22 (gear 22*g*) is rotated in the forward direction denoted with the arrow H1, a contact surface (groove surface) of the forming cam 23 with the forming follower 25*c* functions as a home region 23A, a clamping region 23B, an idle running region 23C, a forming region 23D, and a return region 23E along the rotation direction of the cam 22 (gear 22*g*) with the shaft 22*a* as a fulcrum, as shown in FIG. 13B. In the striking-out mode, in the operation in which the cam 22 (gear 22*g*) is rotated in the forward direction denoted with the arrow H1, the forming follower 25*c* passes through the home region 23A, the clamping region 23B, the idle running region 23C and the forming region 23D in contact with an inner surface of the groove of the forming cam 23, i.e., a radially inner surface of the cam 22 (gear 22*g*). Thereafter, in the operation in which the cam 22 (gear 22*g*) is rotated in the forward direction denoted with the arrow H1, the forming follower 25*c* passes through the return region 23E in contact with an outer surface of the groove of the forming cam 23, i.e., a radially outer surface of the cam 22 (gear 22*g*).

The cam 22 includes the forming cam 23 and the driver cam 24, and has a first cam surface 22H including the forming region 23D for actuating the staple forming unit 2A and the striking-out region 24C for actuating the staple striking-out unit 2B. The first cam surface 22H is at least a surface, which corresponds to the forming region 23D, of the groove surface (contact surface with the forming follower 25*c*) of the forming cam 23 and a surface, which corresponds to the striking-out region 24C, of the groove surface (contact surface with the driver follower 26*c*) of the driver cam 24. Therefore, during execution of the striking-out mode, when the cam 22 (gear 22*g*) is rotated in the forward direction denoted with the arrow H1 and the driver follower 26*c* passes through the striking-out region 24C, the driver plate 21 is actuated via the driver link 26, and when the forming follower 25*c* passes through the forming region 23D, the forming plate 20 is actuated via the forming link 25.

In the initial setting mode, in an operation in which the cam 22 (gear 22*g*) is rotated at a predetermined rotational angle in the reverse direction denoted with the arrow H2, a contact surface (groove surface) of the driver cam 24 with the driver follower 26*c* functions as a home region 24C, and a clamping region 24F along the rotation direction of the cam 22 (gear 22*g*) with the shaft 22*a* as a fulcrum, as shown in FIG. 13C. Further, in the present example, a striking-out regulation region 24G is provided at an end of the clamping region 24F. Further, in the initial setting mode, in an operation in which the cam 22 (gear 22*g*) is rotated at a predetermined rotational angle in the forward direction denoted with the arrow H1, the contact surface (groove surface) of the driver cam 24 with the driver follower 26*c* functions as a return region 24H along the rotation direction of the cam 22 (gear 22*g*) with the shaft 22*a* as a fulcrum, as shown in FIG. 13C.

In the operation in which the cam 22 (gear 22*g*) is rotated at a predetermined rotational angle in the reverse direction denoted with the arrow H2 in the initial setting mode, the driver follower 26*c* passes through the home region 24E, the clamping region 24F, and the striking-out regulation region 24G in contact with an inner surface of the groove of the driver cam 24, i.e., a radially inner surface of the cam 22 (gear 22*g*). In contrast, in the operation in which the cam 22 (gear 22*g*) is rotated at a predetermined rotational angle in the forward direction denoted with the arrow H1 in the initial setting mode, the driver follower 26*c* passes through the return region 24H in contact with an outer surface of the groove of the driver cam 24, i.e., a radially outer surface of the cam 22 (gear 22*g*).

In the initial setting mode, in an operation in which the cam 22 (gear 22*g*) is rotated at a predetermined rotational angle in the reverse direction denoted with the arrow H2, a contact surface (groove surface) of the forming cam 23 with the forming follower 25*c* functions as a home region 23F, a clamping region 23G and a forming region 23H along the rotation direction of the cam 22 (gear 22*g*) with the shaft 22*a* as a fulcrum, as shown in FIG. 13D. In addition, in the initial setting mode, in the operation in which the cam 22 (gear 22*g*) is rotated at a predetermined rotational angle in the forward direction denoted with the arrow H1, the contact surface (groove surface) of the forming cam 23 with the forming follower 25*c* functions as a return region 23J along the rotation direction of the cam 22 (gear 22*g*) with the shaft 22*a* as a fulcrum, as shown in FIG. 13D.

In the operation in which the cam 22 (gear 22*g*) is rotated at a predetermined rotational angle in the reverse direction denoted with the arrow H2 in the initial setting mode, the forming follower 25*c* passes through the home region 23F, the clamping region 23G, and the forming region 23H in contact with an inner surface of the groove of the forming cam 23, i.e., a radially inner surface of the cam 22 (gear 22*g*). In contrast, in the operation in which the cam 22 (gear 22*g*) is rotated at a predetermined rotational angle in the forward direction denoted with the arrow H1 in the initial setting mode, the forming follower 25*c* passes through the return region 23J in contact with an outer surface of the groove of the forming cam 23, i.e., a radially outer surface of the cam 22 (gear 22*g*).

The cam 22 has a second cam surface 22J for actuating the staple forming unit 2A by bypassing all or part of the actuation of the staple striking-out unit 2B by the first cam surface 22H for actuating the staple forming unit 2A and the staple striking-out unit 2B. The second cam surface 22J includes a forming region 23H and a striking-out regulation region 24G. The striking-out regulation region 24G functions to bypass all or part of the actuation of the driver plate 21 of the staple striking-out unit 2B by the striking-out region 24C, which is a part of the first cam surface 22H. For this reason, during execution of the initial setting mode, when the cam 22 (gear 22*g*) is rotated in the reverse direction denoted with the arrow H2, the driver follower 26*c* passes through the striking-out regulation region 24G of the driver cam 24, and the forming follower 25*c* passes through the forming region 23H of the forming cam 23. Thereby, the binding device 100A operates to actuate the staple forming unit 2A by bypassing all or part of the actuation of the staple striking-out unit 2B by the first cam surface 22H.

As described above, when the cam 22 (gear 22*g*) is rotated in the forward direction denoted with the arrow H1, the driver follower 26*c* comes into contact with the striking-out region 24C, and the driver plate 21 of the staple striking-out unit 2B is actuated by the striking-out region 24C of the first cam surface 22H. In contrast, when the cam 22 (gear 22*g*) is rotated in the reverse direction denoted with the arrow H2, the driver follower 26*c* comes into contact with the striking-out regulation region 24G, not the striking-out region 24C, and the striking-out regulation region 24G of the second cam surface 22J bypasses part or all of the actuation of the driver plate 21 of the staple striking-out unit 2B by the striking-out region 24C of the first cam surface 22H.

The first cam surface 22H and the second cam surface 22J are also described as follows. That is, the first cam surface 22H has a staple forming cam surface 22H1 for actuating the staple forming unit 2A and a staple striking-out cam surface 22H2 for actuating the staple striking-out unit 2B.

The staple forming cam surface 22H1 is the forming region 23D with which the forming follower 25*c* comes into contact during execution of the striking-out mode in which the cam 22 is rotated in the forward direction denoted with the arrow H1. In addition, the staple striking-out cam surface 22H2 is the striking-out region 24C with which the driver follower 26*c* comes into contact during execution of the striking-out mode in which the cam 22 is rotated in the forward direction denoted with the arrow H1.

The second cam surface 22J has a staple forming cam surface 22J1 for actuating the staple forming unit 2A and a staple striking-out regulation cam surface 22J2 for bypassing part or all of the staple striking-out cam surface 22H2.

The staple forming cam surface 22J1 is the forming region 23H with which the forming follower 25*c* comes into contact during execution of the initial setting mode in which the cam 22 is rotated in the reverse direction denoted with the arrow H2. In addition, the staple striking-out regulation cam surface 22J2 is the striking-out regulation region 24G with which the driver follower 26*c* comes into contact during execution of the initial setting mode in which the cam 22 is rotated in the reverse direction denoted with the arrow H2.

The staple forming cam surface 22H1, which is the forming region 23D, and the staple forming cam surface 22J1, which is the forming region 23H, are formed on one surface of the cam 22 in the axial direction. In addition, the staple striking-out cam surface 22H2, which is the striking-out region 24C, and the staple striking-out control cam surface 22J2, which is the striking-out regulation region 24G, are formed on the other surface of the cam 22 in the axial direction.

Further, the staple forming cam surface 22J1, which is the forming region 23H, is formed in a region that partially or fully overlaps the staple striking-out cam surface 22H2, which is the striking-out region 24C, and the staple striking-out regulation cam surface 22J2, which is the striking-out regulation region 24G, along the rotation direction of the cam 22.

In the staple forming unit 2A, the forming plate 20 is actuated as the forming follower 25*c* follows the shape of the forming region 23D (staple forming cam surface 22H1). That is, as the forming follower 25*c* follows the shape of the forming region 23D by the operation in which the cam 22 is rotated in the forward direction denoted with the arrow H1, the forming link 25 is rotated. Thereby, the forming plate 20 is moved in the direction of the arrow F10 for forming the staple 10 and in the direction of the arrow F20 away from the formed staple 10, as shown in FIGS. 4B, 4C, 5B and 5C, and the like.

In the staple striking-out unit 2B, the driver plate 21 is actuated as the driver follower 26*c* follows the shape of the striking-out region 24C (staple striking-out cam surface 22H2). That is, as the driver follower 26*c* follows the shape of the striking-out region 24C by the operation in which the cam 22 is rotated in the forward direction denoted with the arrow H1, the driver link 26 is rotated. Thereby, the driver plate 21 is moved in the direction of the arrow F1 for striking out the staple 10 and in the direction of the arrow F2 away from the struck staple 10, as shown in FIGS. 5B and 5C, and the like.

In the staple forming unit 2A, the forming plate 20 is actuated as the forming follower 25*c* follows the shape of the forming region 23H (staple forming cam surface 22J1). That is, as the forming follower 25*c* follows the shape of the forming region 23H by the operation in which the cam 22 is rotated in the reverse direction denoted with the arrow H2, the forming link 25 is rotated. Thereby, the forming plate 20 is moved in the direction of the arrow F10 for forming the staple 10 and in the direction of the arrow F20 away from the formed staple 10, as shown in FIGS. 4B and 4C, and the like.

In the staple striking-out unit 2B, the actuation of the driver plate 21 is restricted as the driver follower 26*c* follows the shape of the striking-out regulation region 24G (staple striking-out regulation cam surface 22J2). That is, as the driver follower 26*c* follows the shape of the striking-out regulation region 24G by the operation in which the cam 22 is rotated in the reverse direction denoted with the arrow H2, the rotation of the driver link 26 is restricted. This restricts the movement of the driver plate 21 in the direction of the arrow F1 for striking out the staple 10 and in the direction of the arrow F2 away from the struck staple 10, as shown in FIGS. 4B and 4C, and the like.

Figure 14A:
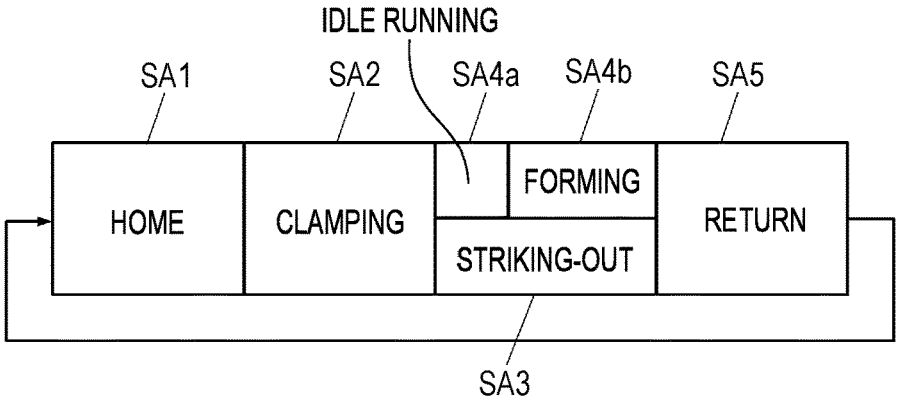
FIG. 14A is an operation illustrating view showing an example of a flow of the striking-out mode.
Figure 14B:
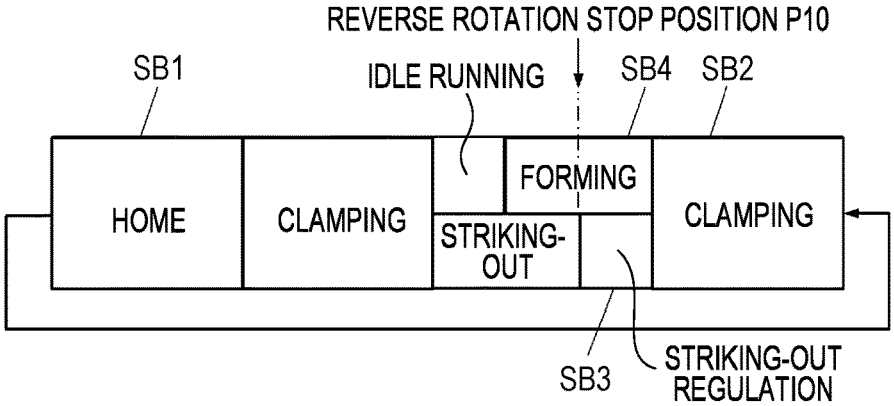
FIG. 14B is an operation illustrating view showing an example of a flow of the initial setting mode.
Figure 14B:
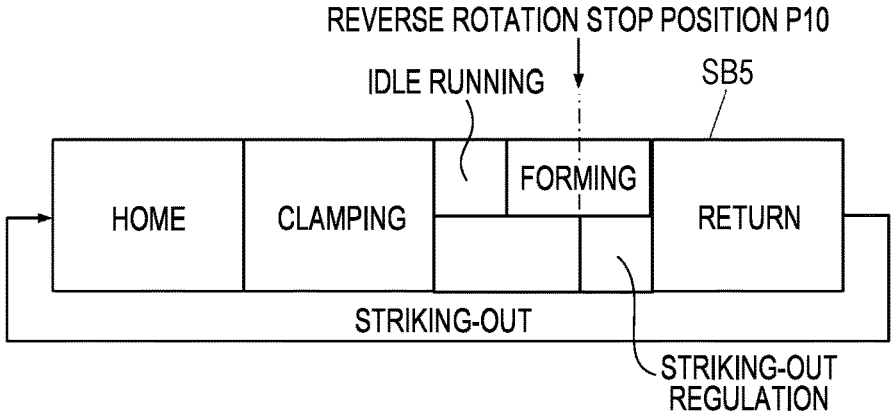
Figure 15A:
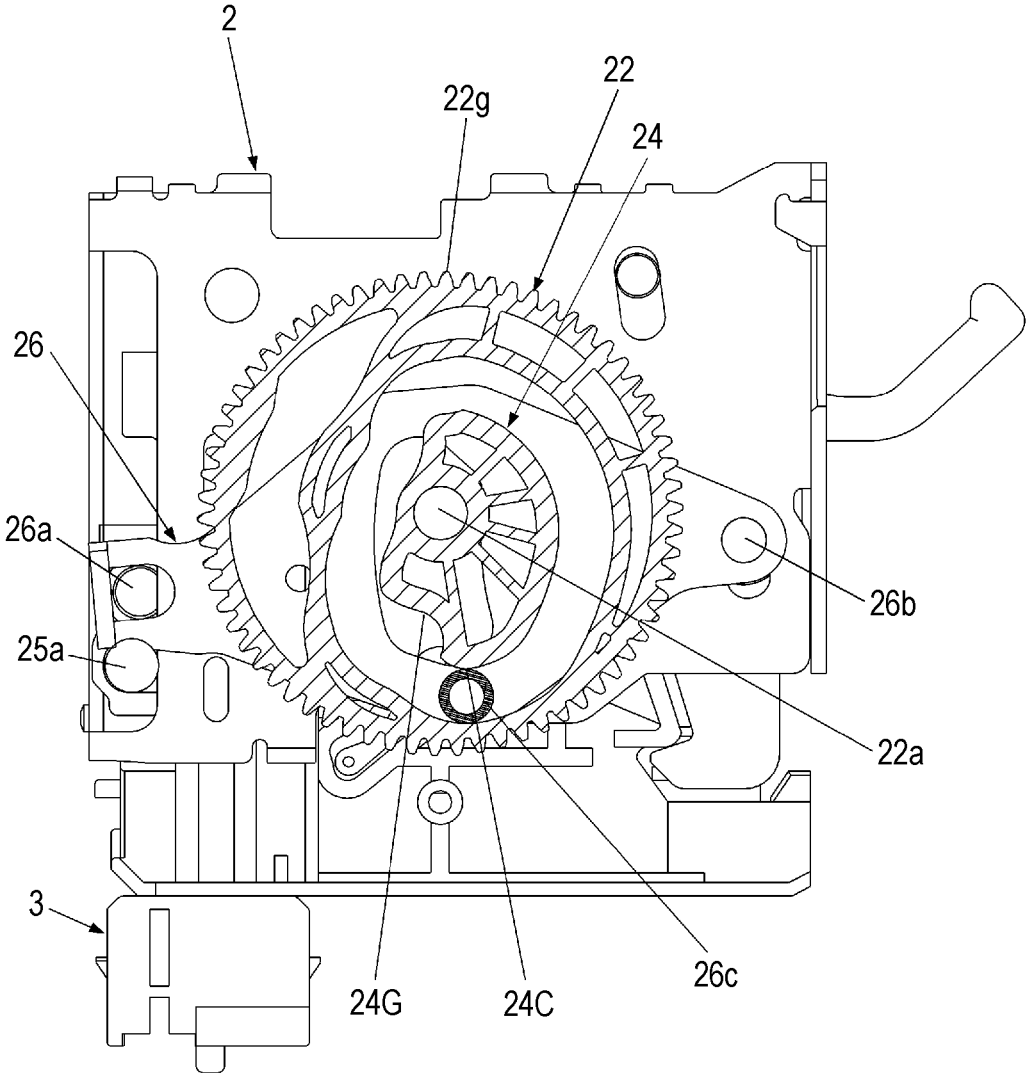
FIG. 15A is a side cross-sectional view showing an example of an operation of the driver cam in the striking-out mode.
Figure 15B:
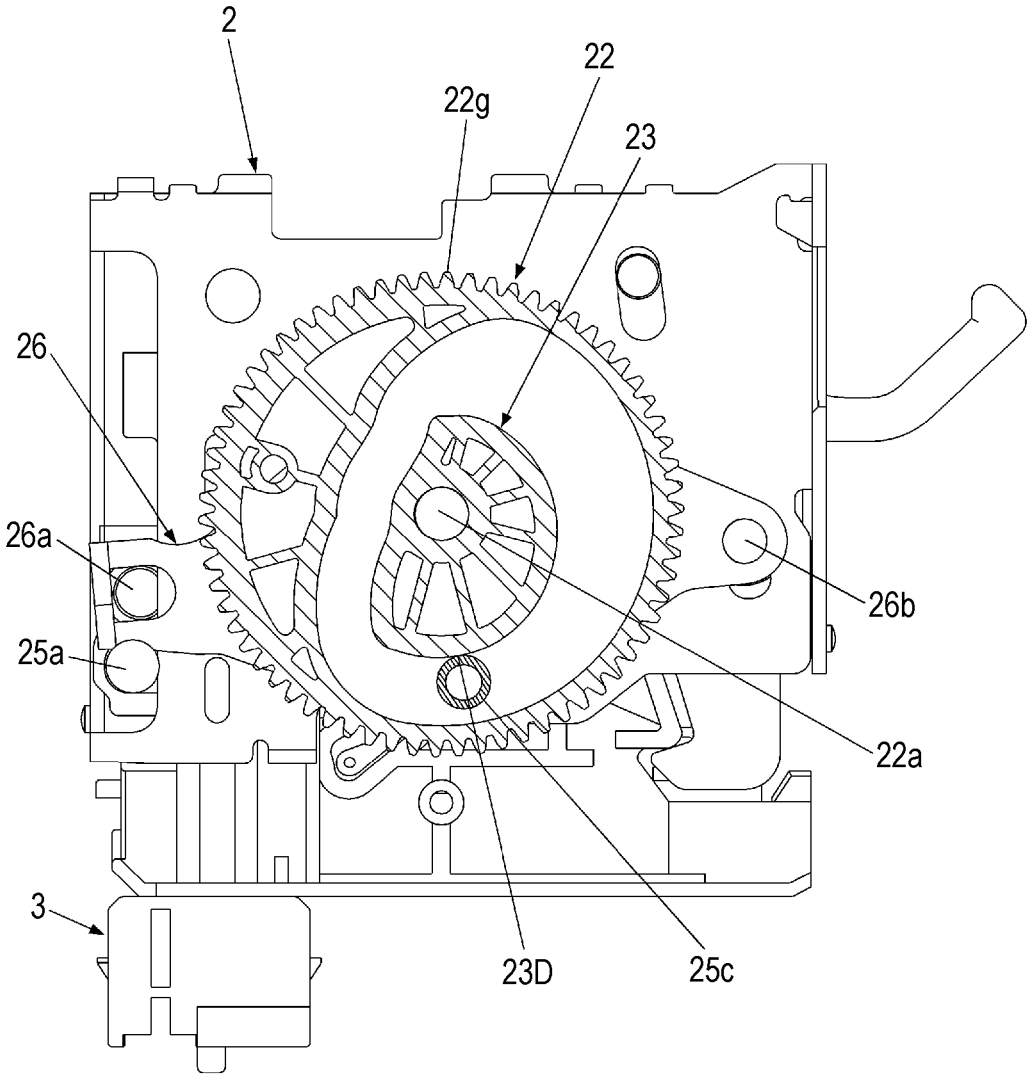
FIG. 15B is a side cross-sectional view showing an example of an operation of the forming cam in the striking-out mode.
Figure 16A:
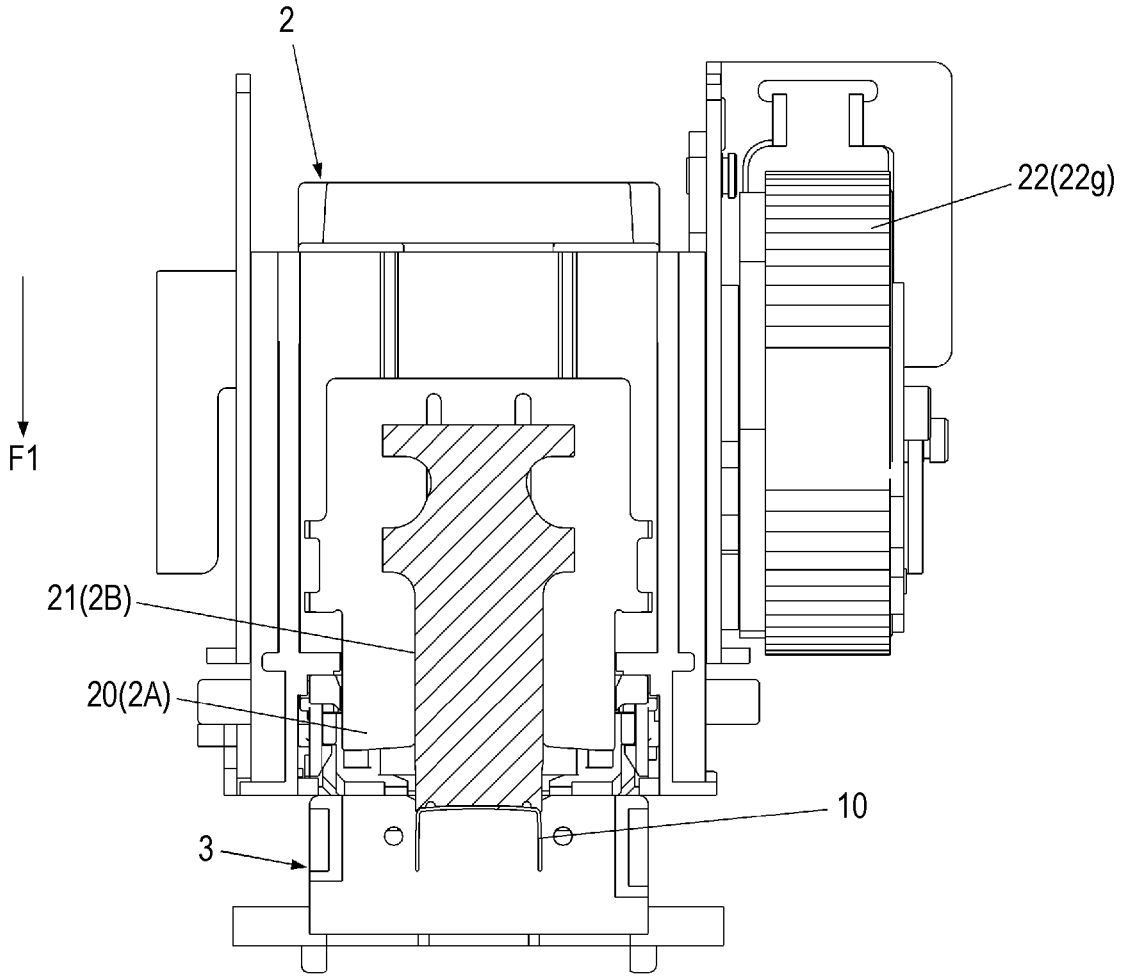
FIG. 16A is a front cross-sectional view showing an example of an operation of a driver plate in the striking-out mode.
Figure 16B:
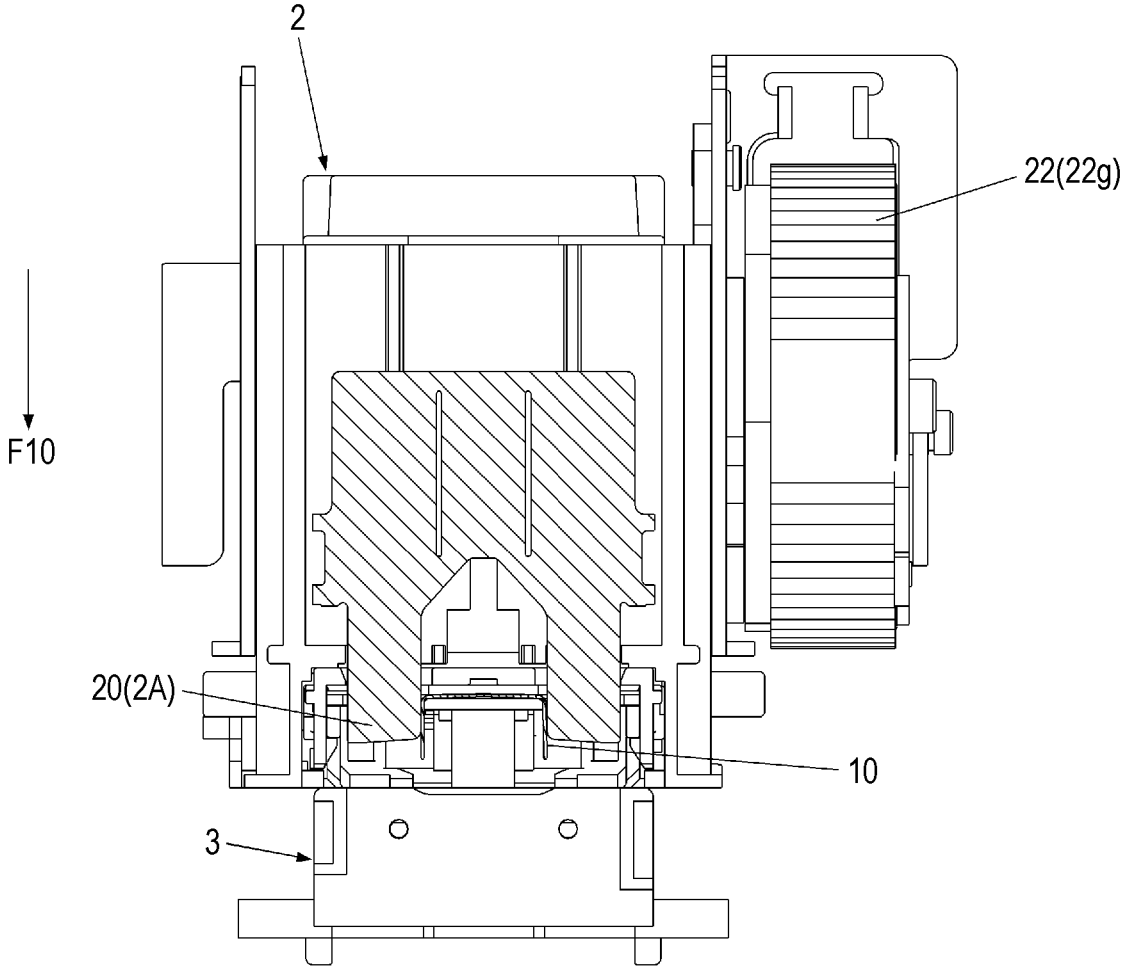
FIG. 16B is a front cross-sectional view showing an example of an operation of a forming plate in the striking-out mode.
Figure 17A:
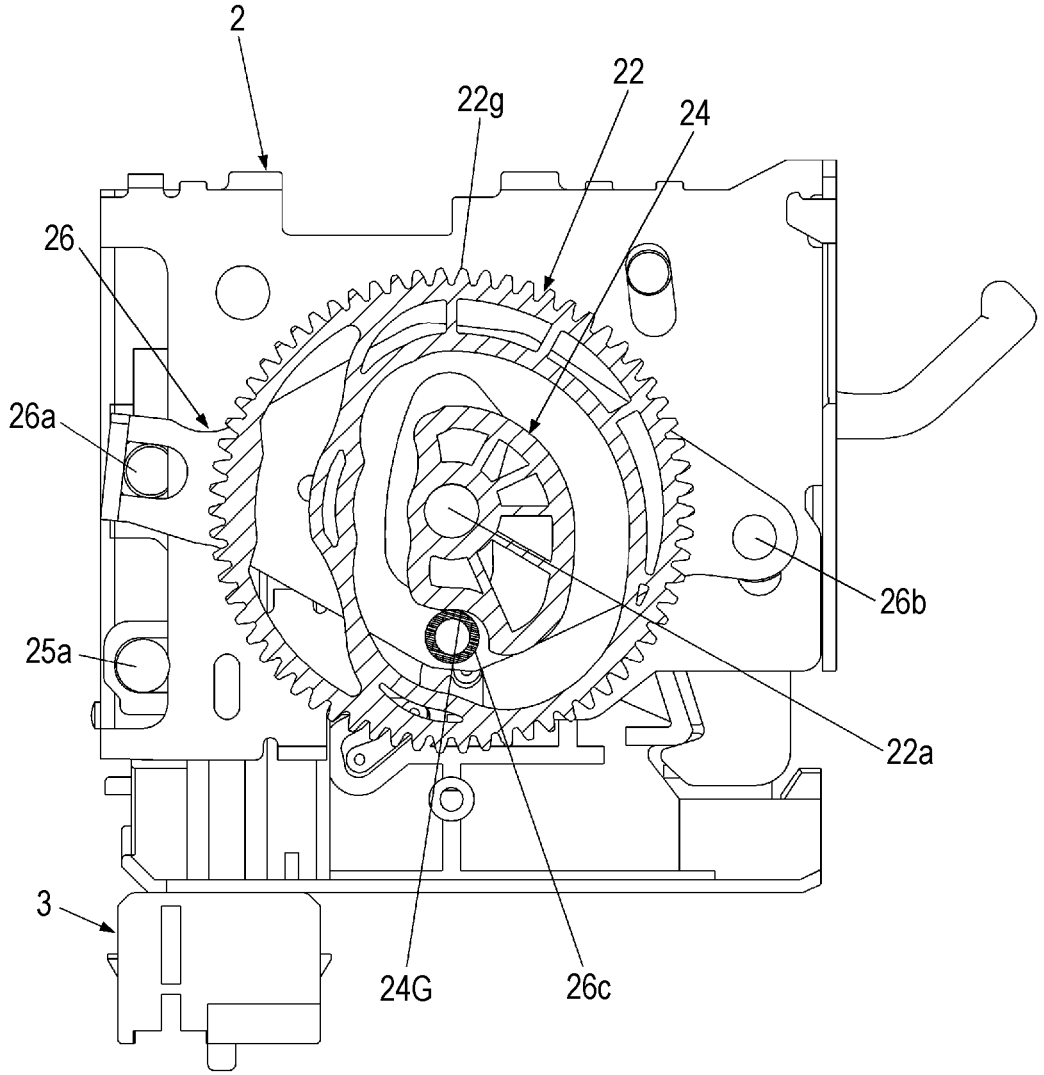
FIG. 17A is a side cross-sectional view showing an example of an operation of the driver cam in the initial setting mode.
Figure 17B:
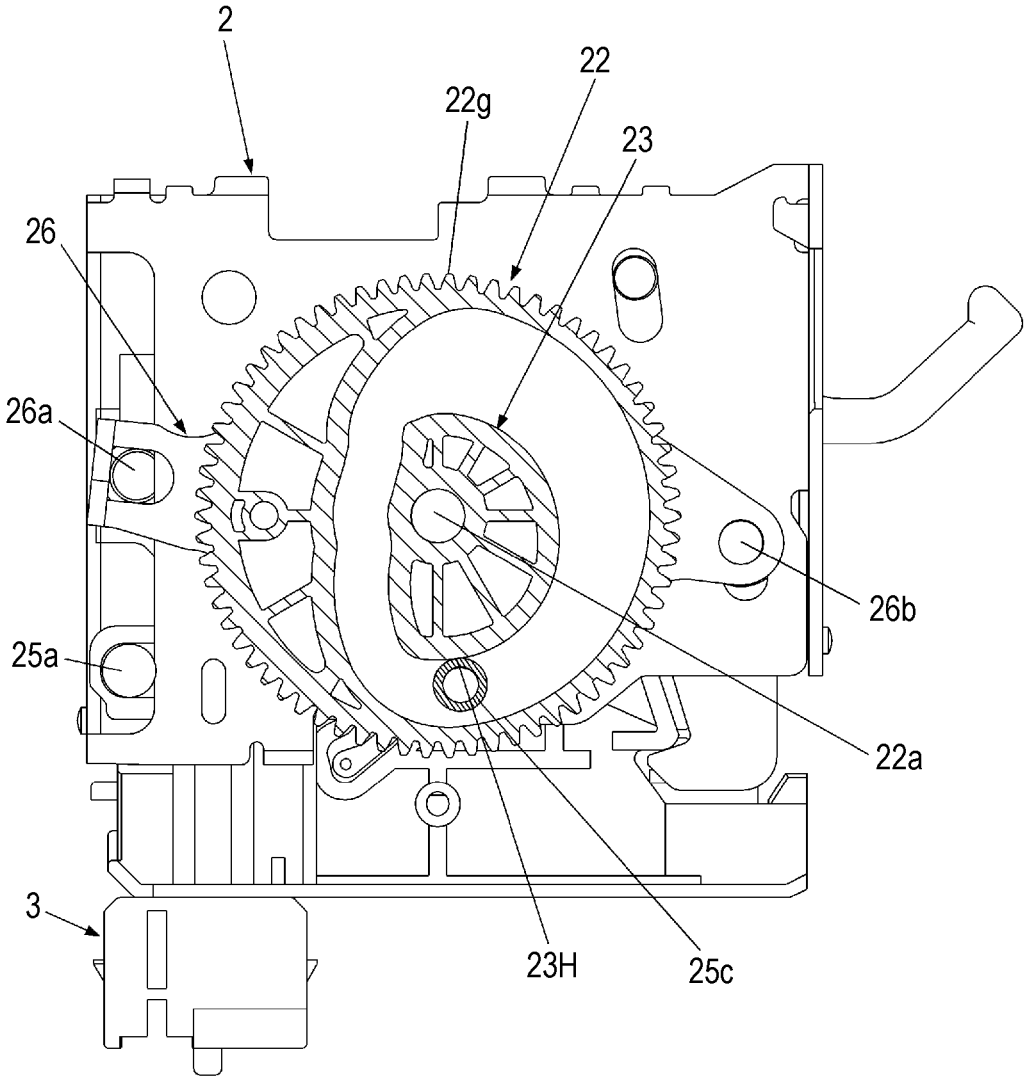
FIG. 17B is a side cross-sectional view showing an example of an operation of the forming cam in the initial setting mode.
Figure 18A:
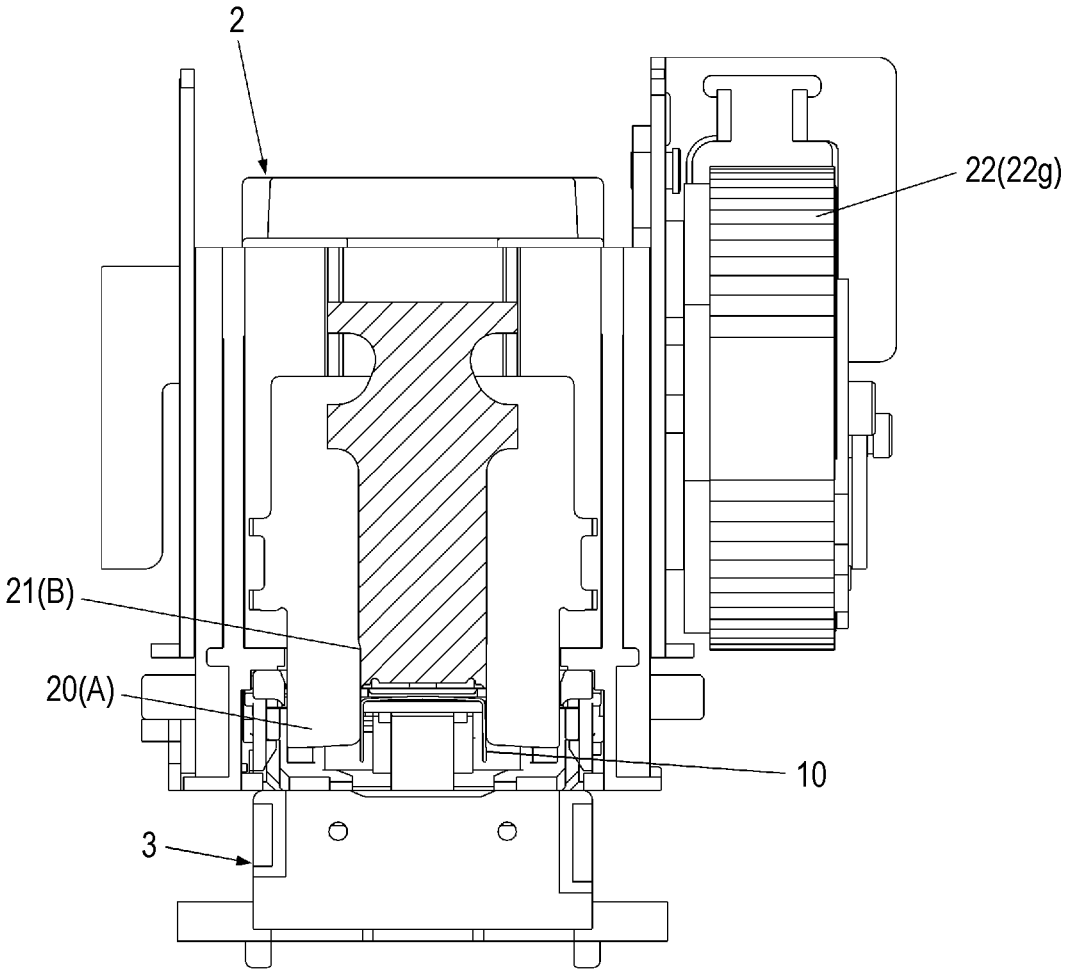
FIG. 18A is a front cross-sectional view showing an example of an operation of the driver plate in the initial setting mode.
Figure 18B:
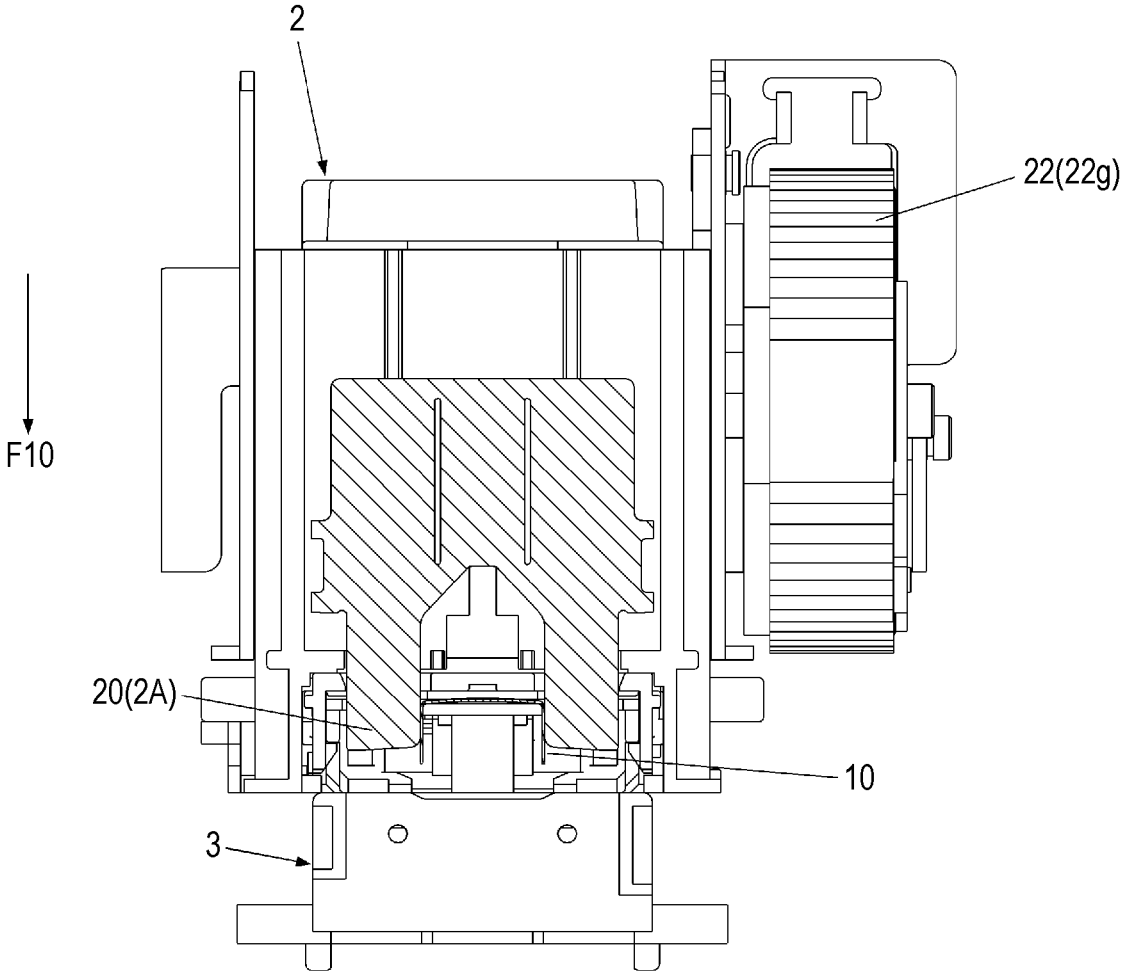
FIG. 18B is a front cross-sectional view showing an example of an operation of the forming plate in the initial setting mode.

FIG. 14A is an operation illustrating view showing an example of a flow of the striking-out mode, and FIG. 14B is an operation illustrating view showing an example of a flow of the initial setting mode. In addition, FIG. 15A is a side cross-sectional view showing an example of an operation of the driver cam in the striking-out mode, and FIG. 15B is a side cross-sectional view showing an example of an operation of the forming cam in the striking-out mode. Further, FIG. 16A is a front cross-sectional view showing an example of an operation of the driver plate in the striking-out mode, and FIG. 16B is a front cross-sectional view showing an example of an operation of the forming plate in the striking-out mode. Further, FIG. 17A is a side cross-sectional view showing an example of an operation of the driver cam in the initial setting mode, and FIG. 17B is a side cross-sectional view showing an example of an operation of the forming cam in the initial setting mode. Further, FIG. 18A is a front cross-sectional view showing an example of an operation of the driver plate in the initial setting mode, and FIG. 18B is a front cross-sectional view showing an example of an operation of the forming plate in the initial setting mode.

In the striking-out mode, the binding device 100A sequentially performs a standby operation at the home position (SA1), a clamping operation (SA2), a striking-out operation (SA3), an idle running operation (Sa4*a*) and a forming operation (SA4*b*), and a return operation (SA5), as shown in FIG. 14A, with the operation in which the cam 22 (gear 22*g*) is rotated in the forward direction denoted with the arrow H1.

On the other hand, in the initial setting mode, the binding device 100A sequentially performs a standby operation at the home position (SB1), a clamping operation (SB2), a striking-out regulation operation (SB3), and a forming operation (SB4), as shown in FIG. 14B, with an operation in which the cam 22 (gear 22*g*) is rotated to a reverse rotation stop position P10 at a predetermined rotational angle in the reverse direction denoted with the arrow H2. In addition, in the initial setting mode, the binding device 100A performs a return operation (SB5), as shown in FIG. 14B, with an operation in which the cam 22 (gear 22*g*) is rotated at a predetermined rotational angle in the forward direction denoted with the arrow H1 from the reverse rotation stop position P10.

With the operation in which the cam 22 (gear 22*g*) is rotated in the forward direction denoted with the arrow H1 in the striking-out mode, the driver follower 26*c* of the driver link 26 is located in the home region 24A, in the standby operation (SA1) at the home position. While the driver follower 26*c* of the driver link 26 is located in the home region 24A, the forming striking-out unit 2 and the bending unit 3 stop at relatively distant standby positions. In addition, the driver plate 21 stops at a standby position distant from the formed staple 10.

With the operation in which the cam 22 (gear 22*g*) is rotated in the forward direction denoted with the arrow H1 in the striking-out mode, the driver follower 26*c* of the driver link 26 is located in the clamping region 24B, in the clamping operation SA2. While the driver follower 26*c* is located in the clamping region 24B, the forming striking-out unit 2 and the bending unit 3 are moved in the direction of the arrow G1 in which they relatively come close to each other, thereby clamping the sheet (bundle). In addition, the driver plate 21 stops at a standby position distant from the formed staple 10.

With the operation in which the cam 22 (gear 22*g*) is rotated in the forward direction denoted with the arrow H1 in the striking-out mode, the driver follower 26*c* of the driver link 26 is located in the striking-out region 24C, in the striking-out operation (SA3), as shown in FIG. 15A. While the driver follower 26*c* is located in the striking-out region 24C, the forming striking-out unit 2 and the bending unit 3 are held in position while clamping the sheet (bundle). Further, as shown in FIG. 16A, the driver plate 21 is moved in the direction of the arrow F1 from the standby position to a striking-out end position, strikes out the formed staple 10 in contact with the formed staple 10.

With the operation in which the cam 22 (gear 22*g*) is rotated in the forward direction denoted with the arrow H1 in the striking-out mode, the driver follower 26*c* of the driver link 26 is located in the return region 24D, in the return operation (SA5). While the driver follower 26*c* is located in the return region 24D, the forming striking-out unit 2 and the bending unit 3 are moved in the direction of the arrow G2 in which they become relatively distant from each other, thereby unclamping the sheet (bundle). Further, the driver plate 21 is moved in the direction of the arrow F2 from the striking-out end position to the standby position, and becomes distant from the struck staple 10.

With the operation in which the cam 22 (gear 22*g*) is rotated in the forward direction denoted with the arrow H1 in the striking-out mode, the forming follower 25*c* of the forming link 25 is located in the home region 23A, in the standby operation (SA1) at the home position. While the forming follower 25*c* is located in the home region 23A, the forming striking-out unit 2 and the bending unit 3 stop at relatively distant standby positions. Further, the forming plate 20 stops at a standby position distant from the sheet staples 11 before forming.

With the operation in which the cam 22 (gear 22*g*) is rotated in the forward direction denoted with the arrow H1 in the striking-out mode, the forming follower 25*c* of the forming link 25 is located in the clamping region 23B, in the clamping operation (SA2). While the forming follower 25*c* is located in the clamping region 23B, the forming striking-out unit 2 and the bending unit 3 are moved in the direction of the arrow G1 in which they relatively come close to each other, thereby clamping the sheet (bundle). Further, the forming plate 20 stops at a standby position distant from the sheet staples 11 before forming.

With the operation in which the cam 22 (gear 22*g*) is rotated in the forward direction denoted with the arrow H1 in the striking-out mode, the forming follower 25*c* of the forming link 25 is located in the idle running region 23C, in the idle running operation (SA4*a*). While the forming follower 25*c* is located in the idle running region 23C, the forming striking-out unit 2 and the bending unit 3 are kept in position while clamping the sheet (bundle). Further, the forming plate 20 stops at a standby position distant from the sheet staples 11 before forming.

With the operation in which the cam 22 (gear 22*g*) is rotated in the forward direction denoted with the arrow H1 in the striking-out mode, the forming follower 25*c* of the forming link 25 is located in the forming region 23D, in the forming operation (SA4*b*), as shown in FIG. 15B. While the forming follower 25*c* is located in the forming region 23D, the forming striking-out unit 2 and the bending unit 3 are held in position while clamping the sheet (bundle). Further, as shown in FIG. 16B, the forming plate 20 is moved in the direction of the arrow F10 from the standby position to the forming end position, and forms the staple 10 in contact with the sheet staple 11.

With the operation in which the cam 22 (gear 22*g*) is rotated in the forward direction denoted with the arrow H1 in the striking-out mode, the forming follower 25*c* of the forming link 25 is located in the return region 23E, in the return operation (SA5). While the forming follower 25*c* is located in the return region 23E, the forming striking-out unit 2 and the bending unit 3 are moved in the direction of the arrow G2 in which they become relatively distant from each other, thereby unclamping the sheet (bundle). Further, the forming plate 20 is moved in the direction of the arrow F20 from the forming end position to the standby position, and becomes distant from the formed staple 10.

In the forming cam surface 22*b* and the driver cam surface 22*c* of the cam 22, the forming cam 23 and the driver cam 24 are configured such that, in the operation in which the cam 22 (gear 22g) is rotated in the forward direction denoted with the arrow H1 in the striking-out mode, the home region 23A of the forming cam 23 and the home region 24A of the driver cam 24 overlap and the clamping region 23B and clamping region 24B overlap along the rotation direction of the cam 22 (gear 22g).

In addition, the forming cam 23 and the driver cam 24 are configured such that, in the operation in which the cam 22 (gear 22g) is rotated in the forward direction denoted with the arrow H1 in the striking-out mode, the idle running region 23C and forming region 23D of the forming cam 23 and the striking-out region 24C of the driver cam 24 overlap along the rotation direction of the cam 22 (gear 22g).

Further, the forming cam 23 and the driver cam 24 are configured such that, in the operation in which the cam 22 (gear 22g) is rotated in the forward direction denoted with the arrow H1 in the striking-out mode, the return region 23E of the forming cam 23 and the return region 24D of the driver cam 24 overlap along the rotation direction of the cam 22 (gear 22g).

Thereby, with the operation in which the cam 22 (gear 22g) is rotated one revolution in the forward direction denoted with the arrow H1 in the striking-out mode, the clamping operation is performed in which the forming striking-out unit 2 and the bending unit 3 are moved in the direction of the arrow G1 in which they relatively come close to each other to clamp the sheet (bundle). In addition, the striking-out operation in which the driver plate 21 is moved in the direction of the arrow F1 from the standby position to the striking-out end position to strike out the staple 10, and the forming operation in which the forming plate 20 is moved in the direction of the arrow F10 from the standby position to the forming end position to form the staple 10 are performed. In addition, the return operation is performed in which the forming striking-out unit 2 and the bending unit 3 are moved in the direction of the arrow G2 in which they become relatively distant from each other to unclamp the sheet (bundle), the driver plate 21 is moved in the direction of the arrow F2 from the striking-out end position to the standby position, and the forming plate 20 is moved in the direction of the arrow F20 from the forming end position to the standby position. When the forming plate 20 is moved in the direction of the arrow F20 from the forming end position to the standby position by the return operation, the staple 10 is fed in the direction of the arrow E1 by the operation of the staple feeding unit 50 described above.

With the operation in which the cam 22 (gear 22g) is rotated at a predetermined rotational angle in the reverse direction denoted with the arrow H2 in the initial setting mode, the driver follower 26c of the driver link 26 is located in the home region 24E, in the standby operation (SB1) at the home position. While the driver follower 26c is located in the home region 24E, the forming striking-out unit 2 and the bending unit 3 stop at relatively distant standby positions. In addition, the driver plate 21 stops at a standby position distant from the formed staple 10.

With the operation in which the cam 22 (gear 22g) is rotated at a predetermined rotational angle in the reverse direction denoted with the arrow H2 in the initial setting mode, the driver follower 26c of the driver link 26 is located in the clamping region 24F, in the clamping operation (SB2). While the driver follower 26c is located in the clamping region 24F, the forming striking-out unit 2 and the bending unit 3 are moved in the direction of the arrow G1 in which they relatively come close to each other. In addition, the driver plate 21 stops at a standby position distant from the formed staple 10.

With the operation in which the cam 22 (gear 22g) is rotated at a predetermined rotational angle in the reverse direction denoted with the arrow H2 in the initial setting mode, the driver follower 26c of the driver link 26 is located in the striking-out regulation region 24G, in the striking-out regulation operation (SB3), as shown in FIG. 17A. While the driver follower 26c is located in the striking-out regulation region 24G, the forming striking-out unit 2 and the bending unit 3 are held in position while clamping the sheet. In addition, as shown in FIG. 18A, the driver plate 21 stops at a standby position distant from the formed staple 10.

Note that, in the striking-out regulation region 24G, the shape of the driver cam 24 may be set to stop the driver plate 21 at the standby position, and the shape of the driver cam 24 may be set to move the driver plate 21 in the direction of the arrow F1 from the standby position within a range in which the staple 10 is not struck out.

In addition, the driver cam 24 is formed with a rotation regulation portion 24J at which the driver follower 26c of the driver link 26 is located in the striking-out regulation region 24G and which regulates the rotation of the cam 22 (gear 22g) at a rotational angle of the cam 22 (gear 22g) at which the movement of the driver plate 21 striking out the staple 10 is regulated. The rotation regulation portion 24J is configured by providing a surface extending along the radial direction of the cam 22 (gear 22g) at an end portion of the striking-out regulation region 24G. When the cam 22 (gear 22g) is rotated in the reverse direction denoted with the arrow H2 and the driver follower 26c of the driver link 26 is located in the striking-out regulation region 24G and comes into contact with the rotation regulation portion 24J, the driver follower 26c cannot overcome the rotation regulation portion 24J, and the rotation of the cam 22 (gear 22g) is thus regulated.

In the present example, by providing the rotation regulation portion 24J at the terminal end portion of the striking-out regulation region 24G, the driver follower 26c is prevented from entering the striking-out region 24c during rotation of the cam 22 (gear 22g) in the direction of the arrow H2. Specifically, the rotation regulation portion 24J has a shape that sharply changes in the direction in which the driver follower 26c becomes distant from the shaft 22a when the cam 22 (gear 22g) is rotated in the direction of the arrow H2. In order for the driver follower 26c to follow the sharp change in shape of the rotation regulation portion 24J, a high driving force from the motor 101 serving as a driving source is momentarily required. Since the motor 101 that drives the binding device 100A usually does not have a driving force enough to be able to follow the sharp change in shape of the cam 22, the driver follower 26c cannot overcome the striking-out rotation regulation portion 24J and thus stops. In this way, the rotation regulation portion 24J, which is provided at the terminal end portion of the striking-out regulation region 24G and has a sharply changing shape, substantially regulates the movement of the driver plate 21.

Note that the rotation of the cam 22 (gear 22g) may be controlled and stopped before the driver follower 26c comes into contact with the rotation regulation portion 24J. Specifically, rotational position control using an encoder, a stepping motor, or the like may be performed to set the stop position within the striking-out regulation region 24G. Alternatively, the stop position may be controlled using a driving time of the motor 101. Alternatively, a detected part may be provided in a stop region of the cam 22 (gear 22g), and a detection means for detecting the stop region may be provided in the forming striking-out unit 2 for control.

With the operation in which the cam 22 (gear 22*g*) is rotated at a predetermined rotational angle in the forward direction denoted with the arrow H1 in the initial setting mode, the driver follower 26*c* of the driver link 26 is located in the return region 24H, in the return operation (SB5). While the driver follower 26*c* is located in the return region 24H, the forming striking-out unit 2 and the bending unit 3 are moved in the direction of the arrow G2 in which they become relatively distant from each other. In addition, the driver plate 21 is moved in a direction away from the formed staple 10.

With the operation in which the cam 22 (gear 22*g*) is rotated at a predetermined rotational angle in the reverse direction denoted with the arrow H2 in the initial setting mode, the forming follower 25*c* of the forming link 25 is located in the home region 23F, in the standby operation (SB1) at the home position. While the forming follower 25*c* is located in the home region 23F, the forming striking-out unit 2 and the bending unit 3 stop at relatively distant standby positions. Further, the forming plate 20 stops at a standby position distant from the sheet staples 11 before forming.

With the operation in which the cam 22 (gear 22*g*) is rotated at a predetermined rotational angle in the reverse direction denoted with the arrow H2 in the initial setting mode, the forming follower 25*c* of the forming link 25 is located in the clamping region 23G, in the clamping operation (SB2). While the forming follower 25*c* is located in the clamping region 23G, the forming striking-out unit 2 and the bending unit 3 are moved in the direction of the arrow G1 in which they relatively come close to each other. Further, the forming plate 20 is moved in the direction approaching the sheet staples 11 before forming.

With the operation in which the cam 22 (gear 22*g*) is rotated at a predetermined rotational angle in the reverse direction denoted with the arrow H2 in the initial setting mode, the forming follower 25*c* of the forming link 25 is located in the forming region 23H, in the forming operation (SB4), as shown in FIG. 17B. While the forming follower 25*c* is located in the forming region 23H, the forming striking-out unit 2 and the bending unit 3 are held in position while clamping the sheet. Further, as shown in FIG. 18B, the forming plate 20 is moved in the direction of the arrow F10 from the standby position to the forming end position, and forms the staple 10 in contact with the sheet staple 11.

The forming region 23H in the operation in which the cam 22 (gear 22*g*) is rotated in the reverse direction denoted with the arrow H2 in the initial setting mode overlaps part of the forming region 23D in the operation in which the cam 22 (gear 22*g*) is rotated in the forward direction denoted with the arrow H1 in the striking-out mode. In the forming region 23D in the operation in which the cam 22 (gear 22*g*) is rotated in the forward direction denoted with the arrow H1 in the striking-out mode, in a downstream region along the rotation direction, the forming plate 20 is moved in the direction of the arrow F20 from the forming end position toward the standby position. Thereby, in the forming region 23H in the operation in which the cam 22 (gear 22*g*) is rotated in the reverse direction denoted with the arrow H2 in the initial setting mode, the forming plate 20 is moved in the direction of the arrow F10 from the standby position toward the forming end position.

With the operation in which the cam 22 (gear 22*g*) is rotated at a predetermined rotational angle in the forward direction denoted with the arrow H1 in the initial setting mode, the forming follower 25*c* of the forming link 25 is located in the return region 24H, in the return operation (SB5). While the forming follower 25*c* is located in the return region 24H, the forming striking-out unit 2 and the bending unit 3 are moved in the direction of the arrow G2 in which they become relatively distant from each other. Further, the forming plate 20 is moved in the direction of the arrow F20 from the forming end position to the standby position, and becomes distant from the formed staple 10. When the forming plate 20 is moved in the direction of the arrow F20 from the forming end position to the standby position, the staple 10 is fed in the direction of the arrow E1 by the operation of the staple feeding unit 50 described above.

In the forming cam surface 22*b* and the driver cam surface 22*c* of the cam 22, the forming cam 23 and the driver cam 24 are configured such that, in the operation in which the cam 22 (gear 22*g*) is rotated at a predetermined rotational angle in the reverse direction denoted with the arrow H2 in the initial setting mode, the home region 23F of the forming cam 23 and the home region 24E of the driver cam 24 overlap, the clamping region 23G and the clamping region 24G overlap and the forming region 23H and the striking-out regulation region 24G overlap along the rotation direction of the cam 22 (gear 22*g*).

In addition, the forming cam 23 and the driver cam 24 are configured such that, in the operation in which the cam 22 (gear 22*g*) is rotated at a predetermined rotational angle in the forward direction denoted with the arrow H1 in the initial setting mode, the return region 23J of the forming cam 23 and the return region 24H of the driver cam 24 overlap along the rotation direction of the cam 22 (gear 22*g*).

Thereby, with the operation in which the cam 22 (gear 22*g*) is rotated at a predetermined rotational angle in the reverse direction denoted with the arrow H2 in the initial setting mode, the clamping operation is performed in which the forming striking-out unit 2 and the bending unit 3 are moved in the direction of the arrow G1 in which they relatively come close to each other. Note that, in the initial setting mode, it is not necessary to clamp the sheet (bundle).

In addition, the forming operation is performed in which as the forming follower 25*c* of the forming link 25 is moved following the shape of the forming region 23H of the forming cam 23 and the forming link 25 is thus rotated, the forming plate 20 is moved in the direction of the arrow F10 from the standby position to the forming end position to form the staple 10.

In contrast, as the driver follower 26*c* of the driver link 26 is moved following the shape of the striking-out regulation region 24G of the driver cam 24, the movement of the driver plate 21 to strike out the staple 10 is regulated.

Note that, in a configuration where the driver cam 24 is not provided with the striking-out regulation region 24G, the operation of the cam 22 (gear 22*g*) rotating in the reverse direction causes the driver plate 21 to move from the standby position to the striking-out end position, and the staple 10 is struck out. Therefore, the driver cam 24 is provided with the striking-out regulation region 24G to regulate the movement of the driver plate 21 to strike out the staple 10 while the cam 22 (gear 22*g*) is rotated at a predetermined rotational angle in the reverse direction. In addition, when the rotation regulation portion 24J is provided at the terminal end portion of the regulation region 24G, even if the cam 22 (gear 22*g*) has not stopped at a stage where the driver follower 26*c* is within the regulation region 24G, the driver follower 26*c* cannot overcome the rotation regulation portion 24J, and therefore, unintentional striking-out of the staple 10 can be prevented reliably.

In addition, with the operation in which the cam 22 (gear 22*g*) is rotated at a predetermined rotational angle in the forward direction denoted with the arrow H1 in the initial setting mode, the return operation is performed in which the forming striking-out unit 2 and the bending unit 3 are moved in the direction of the arrow G2 in which they become relatively distant from each other to clamp the sheet and the forming plate 20 is moved in the direction of the arrow F20 from the forming end position to the standby position. When the forming plate is moved in the direction of the arrow F20 from the forming end position to the standby position by the return operation, the staple 10 is fed in the direction of the arrow E1 by the operation of the staple feeding unit 50 described above.

The binding device 100A includes the cam 22 as an example of the actuation unit that comes into contact with the forming plate 20 of the staple forming unit 2A via the forming link or the like and comes into contact with the driver plate 21 of the staple striking-out unit 2B via the driver link 26 or the like. The forming plate 20 or the driver plate 21 is configured to be actuated according to the rotation direction and rotational angle (displacement amount) of the cam 22 (gear 22*g*). The control unit 210 shown in FIG. 2 controls the rotation direction of the cam 22 (gear 22*g*), which is a displacement direction of the actuation unit, and the rotational angle of the cam 22 (gear 22*g*), which is a displacement amount of the actuation unit, to switch the number of actuations of the forming plate 20 of the staple forming unit 2A and the presence or absence of actuation of the driver plate 21 of the staple striking-out unit 2B.

In this way, by controlling the rotation direction and rotational angle of the cam 22 (gear 22*g*), the striking-out mode and the initial setting mode are switched.

Note that an amount of movement of the forming plate 20 is determined by a length of the forming region 23D and forming region 23H in the forming cam 23 along a circumferential direction of cam 22 (gear 22*g*) and an amount of change in distance from the center of the cam 22 (gear 22*g*). In addition, an amount of movement of the driver plate 21 is determined by a length of the striking-out region 24C in the driver cam 24 along the circumferential direction of the cam 22 (gear 22*g*) and the amount of change in distance from the center of the cam 22 (gear 22*g*). When the length of the forming region 23D and forming region 23H along the circumferential direction of the cam 22 (gear 22*g*) is increased, even if a ratio of the amount of change in distance from the center of the cam 22 (gear 22*g*) is reduced, a required amount of movement of the forming plate 20 can be secured. However, in this case, it is necessary to increase a diameter of the cam 22 (gear 22*g*), and the same applies to the driver plate 21 side. In contrast, when the forming cam 23 is formed on one surface of the cam 22 (gear 22*g*) and the driver cam 24 is formed on the other surface, a region where the forming region 23D and forming region 23H, and the striking-out region 24C overlap along the circumferential direction of the cam 22 (gear 22*g*) can be provided. This makes it possible to secure the required amounts of movement of the forming plate 20 and the driver plate 21 while suppressing enlargement of the diameter of the cam 22 (gear 22*g*). On the other hand, if the forming region 23H and the striking-out region 24C overlap along the circumferential direction of the cam 22 (gear 22*g*), it is not possible to move only the forming plate 20 by an amount of movement required for forming of the staple 10. Therefore, by forming the driver cam 24 with the striking-out regulation region 24G, the forming plate 20 can be actuated while regulating the actuation of the driver plate 21.

<Example of Another Embodiment of Binding Device>

Figure 19:
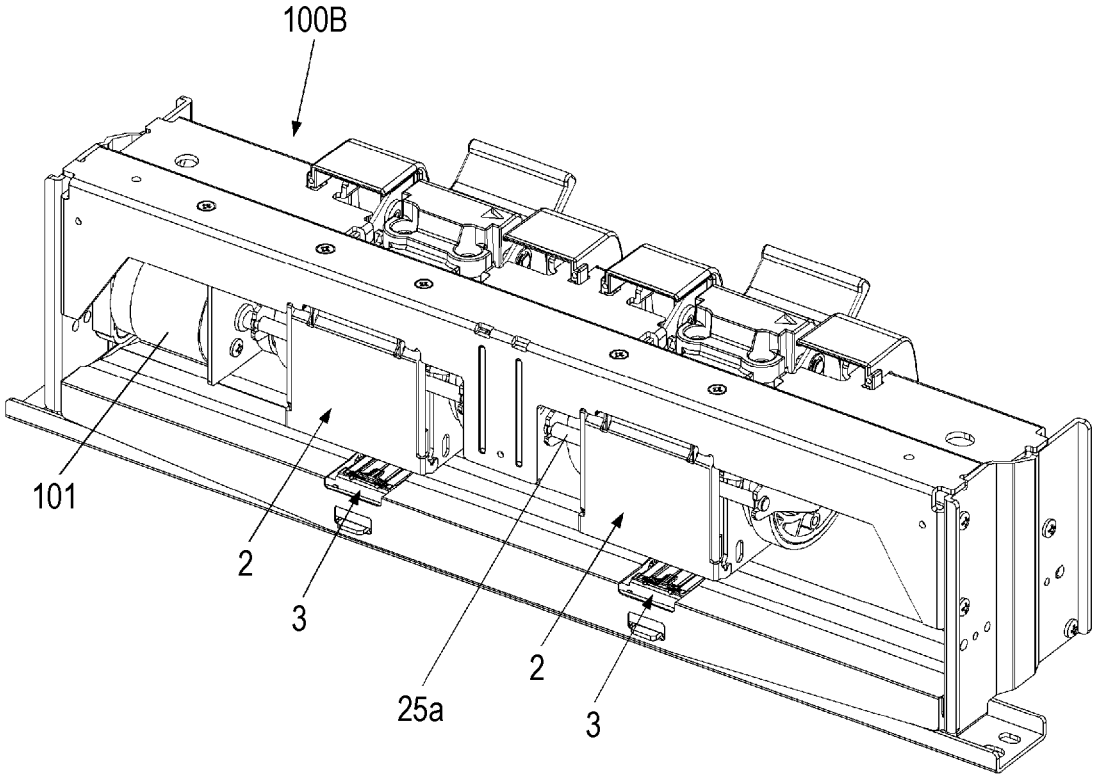
FIG. 19 is a perspective view showing an example of another embodiment of the binding device.

FIG. 19 is a perspective view showing an example of another embodiment of the binding device.

A binding device 100B includes a plurality of, in this example, two forming striking-out units 2 and two bending units 3 described above. In the binding device 100B, in order to bind folds of, for example, booklet-shaped sheets, the two forming striking-out units 2 and bending units 3 are arranged at a predetermined interval with such an arrangement that binding positions of the respective forming striking-out units 2 and bending units 3 are aligned in a row.

The forming striking-out unit 2 includes a staple forming unit 2A that forms a staple 10 in the staple forming process and feeds (moves) the formed staple 10 toward the striking-out position, a staple striking-out unit 2B that strikes out the staple 10 at the striking-out position in the staple striking-out process, and a cam 22 (actuation unit) that actuates the staple forming unit 2A and the staple striking-out unit 2B. In the present example, the cam 22 is a rotatable flat plate cam.

The staple forming unit 2A includes a forming plate 20 for forming the staple 10 and a staple feeding unit 50 for feeding (moving) the staple 10 toward the striking-out position. The staple striking-out unit 2B includes a driver plate 21 for striking out the staple 10 formed by the forming plate 20. The cam 22 has a gear 22*g*. The cam 22 (gear 22*g*) is configured to be displaceable (rotatable in the present example), and the staple forming unit 2A and the staple striking-out unit 2B can be actuated by displacing (rotating) the cam 22.

The binding device 100B includes a plurality of staple forming units 2A (forming plates 20 and staple feeding units 50) that form staples and move the same toward the striking-out positions, and a plurality of staple striking-out units 2B (driver plates 21) that strike out the staples 10 at the striking-out positions, and a plurality of cams 22 (gears 22*g*) for actuating the staple forming units 2A and the staple striking-out units 2B. The cam 22 (gear 22*g*) of each forming striking-out unit 2 is connected by a connecting portion 25*a* or the like such that a forming cam 23 and a driver cam 24 are in phase.

The binding device 100B includes a motor 101 that drives the cam 22 (gear 22*g*) of each forming striking-out unit 2. The two forming striking-out units 2 have a configuration in which a driving force of the single motor 101 is transmitted to each cam 22 (gear 22*g*) via a shaft, a gear or the like, and each cam 22 (gear 22*g*) is rotated synchronously by the driving of the motor 101.

In the binding device 100B, the motor 101 is controlled by the above-described control unit 210 shown in FIG. 2.

The binding device 100B executes the first mode (striking-out mode) and the second mode (initial setting mode) based on an operation on the operation unit 203A, or the like. In the striking-out mode, the control unit 210 controls the motor 101 to rotate the cam 22 (gear 22*g*) of each forming striking-out unit 2 once in the forward direction. Note that, in the present example, the cam 22 (gear 22*g*) is rotated once in the forward direction, but the binding device may include a gear having a configuration where one cycle in which the cam is forward rotated halfway at a rotational angle of less than one revolution and is then reversely rotated and returned can be set as a striking-out mode. Further, in the initial setting mode, the control unit 210 controls the motor 101 to rotate the cam 22 (gear 22*g*) of each forming striking-out unit 2 in the reverse and forward directions at predetermined rotational angles.

Figure 20A:
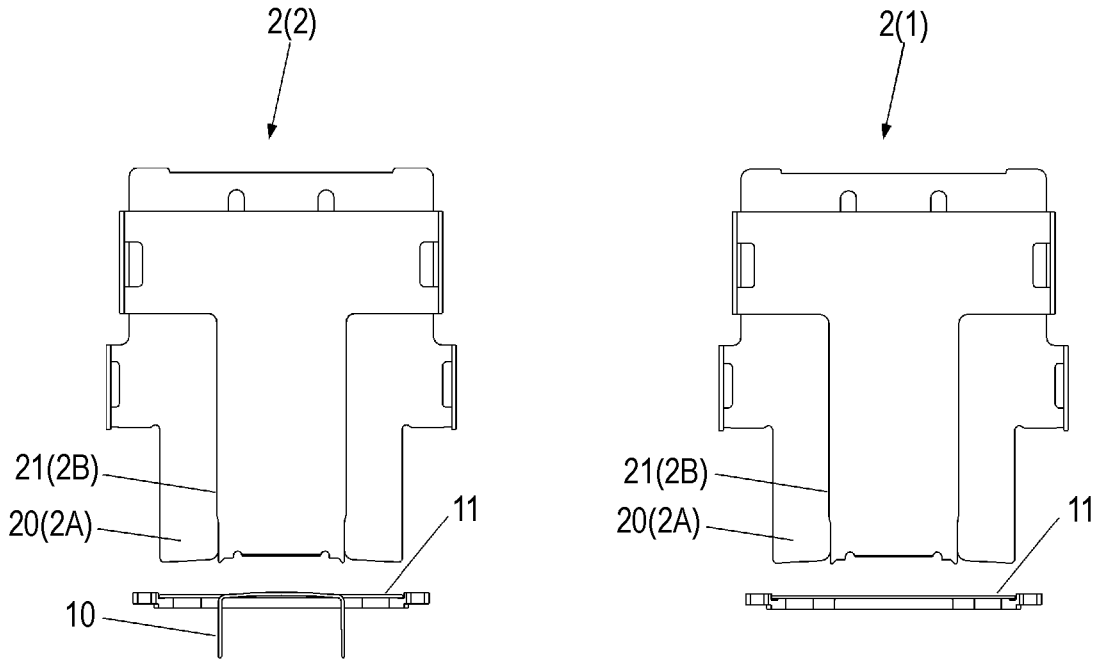
FIG. 20A is an operation illustrating view showing an example of the initial setting operation in the binding device having two forming striking-out units.
Figure 20B:
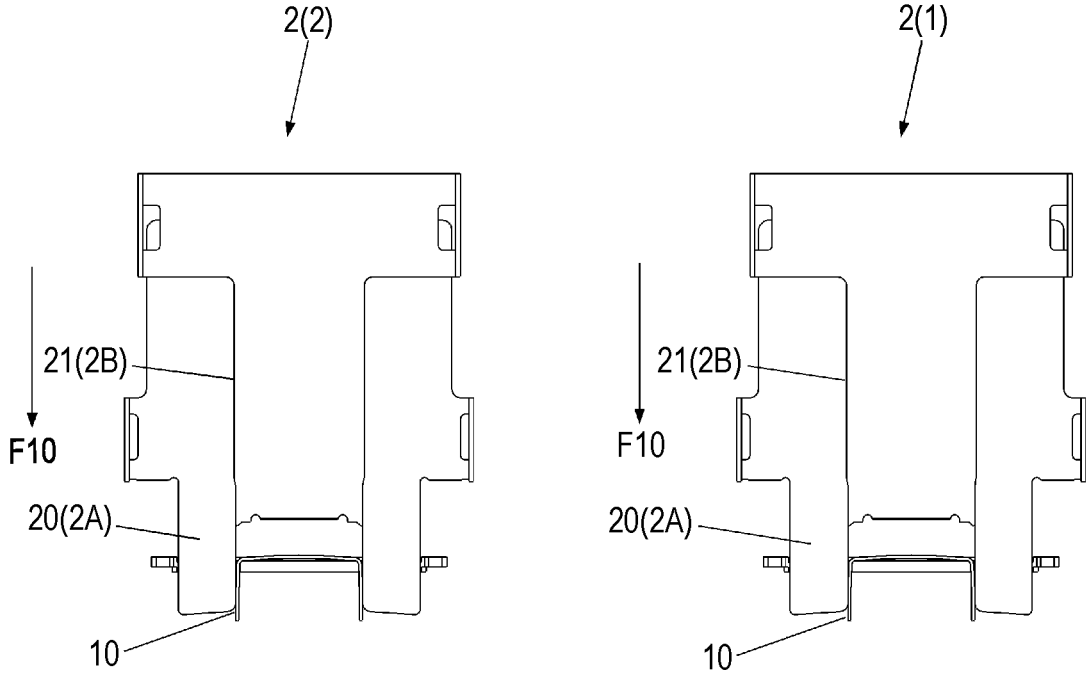
FIG. 20B is an operation illustrating view showing an example of the initial setting operation in the binding device having two forming striking-out units.

FIGS. 20A and 20B are operation illustrating views showing an example of the initial setting operation in the binding device having two forming striking-out units. In the binding device 100B, a situation is considered in which an obstacle such as clogging of the staple 10 intended to be struck out by one forming striking-out unit 2(1) occurred, and the staple 10, which was the cause of the obstacle, was removed from the forming striking-out unit 2(1). In this case, as shown in FIG. 20A, in one forming striking-out unit 2(1) from which the staple 10, which was the cause of the obstacle, has been removed, the staple 10 is not present at the striking-out position by the driver plate 21. In contrast, in the other forming striking-out unit 2(2) where no obstacle has occurred, the formed staple 10 is present at the striking-out position by the driver plate 21.

Therefore, upon recovery from such an obstacle, the initial setting mode described above is executed. When the initial setting mode is executed in the binding device 100B, as shown in FIG. 20B, a forming operation is performed in which the forming plate 20 is moved in the direction of the arrow F10 from the standby position to the forming end position to form a staple 10.

In contrast, as the driver follower 26*c* of the driver link 26 is moved following the shape of the striking-out regulation region 24G of the driver cam 24, the movement of the driver plate 21 to strike out the staple 10 is regulated.

In the other forming striking-out unit 2(2), the formed staple 10 is already present at the striking-out position of the driver plate 21. However, since the driver plate 21 does not contact the staple 10, the staple 10 is not struck out.

That is, in the case of driving the two cams 22 (gears 22*g*) synchronized by the single motor 101, the forming of the staples 10 by the two forming plates 20 can be performed simultaneously without bringing the two driver plates 21 into contact with the staples 10. When this operation is repeated, the staple 10 is not struck out by the driver plate 21 in any of the plurality of forming striking-out units 2, and the forming of the staple 10 by the forming plate is repeated. Thereby, in the plurality of forming striking-out units 2, the initial setting can be performed by moving the staples 10 formed without involving the striking-out of the staple to positions where they can be struck out by the driver plates 21.

Note that, in the present example, the forming plate 20 is provided spaced apart from the driver plate 21 with a gap corresponding to one width of the staple 10 in the width direction. Therefore, in the initial setting mode, the control unit 210 performs two times or more the operation of rotating the cam 22 (gear 22*g*) at a predetermined rotational angle in the reverse direction denoted with the arrow H2 and in the forward direction denoted with the arrow H1, thereby moving the formed staple 10 to the striking-out position by the driver plate 21.

The forming striking-out unit 2 mounted on the binding device 100A and the binding device 100B is configured to be able to execute the initial setting mode by moving the forming plate while regulating the movement of the plate 21 with the shape of the driver cam 24 and forming cam 23 provided on the cam 22 (gear 22*g*) and the rotation direction and rotational angle of the cam 22 (gear 22*g*). Thereby, an idle striking mark due to idle striking is not left on the sheet. In addition, it is possible to execute the initial setting mode for the staple 10 without a sensor for detecting the leading staple of the sheet staples.

Further, in the binding device 100A and the binding device 100B, the staple 10 is not struck out when executing the initial setting mode. For this reason, when executing the initial setting mode, a sheet for trial striking-out of the staple 10 is unnecessary. For this reason, when the binding device 100A and the binding device 100B are applied to the post-processing apparatus 202A of the image forming apparatus 201A, the initial setting mode can be executed without receiving sheet supply from the image forming apparatus 201A. Therefore, a signal instructing execution of the initial setting mode may be output to the binding devices 100A and 100B (post-processing apparatus 202A) without outputting a sheet on the image forming apparatus 201A side. In addition, the initial setting mode may be executed by an operation of the single binding device 100A, 100B (post-processing apparatus 202A), or when executing the initial setting mode by an operation of the single binding device 100A, 100B (post-processing apparatus 202A), whether to execute the initial setting mode may be determined according to a state on the image forming apparatus 201A side, and the initial setting mode may be executed according to an instruction to enable execution.

Note that, in the image forming system 200A, the initial setting mode described above may be executed after the start of a return operation of the post-processing apparatus 202A, such as when a power supply is turned on, when power is recovered after a power failure, or when returning from a power saving mode. In addition, after the start of the return operation of the post-processing apparatus 202A, the cam 22 (gear 22*g*) may be rotated in a predetermined direction and by a predetermined amount to locate the cam at the home position, and then the initial setting mode described above may be executed. Further, after a door (not shown) for maintenance provided for the post-processing apparatus 202A is opened, when it is detected that the door is closed, the initial setting mode described above may be executed. Further, when a state change (signal change) related to the binding device, such as a change in the presence or absence of the staple 10, is detected after the door of the post-processing apparatus 202A is opened until the door is closed, the initial setting mode described above may be executed, and when the initial setting for the staple 10 is not required, such as paper jam, the initial setting mode described above may not be executed. On the other hand, even when the image forming system 200A is stopped due to a factor other than a state change caused by the binding device 100A, the initial setting mode described above may be executed upon return. In addition, the initial setting mode described above may not be executed after the staple 10 is replaced after the remaining amount of the staple 10 is consumed. Further, the initial setting mode described above may be executed at any timing, regardless of whether the image forming system 200A is in stop or in operation. Further, while the initial setting mode described above is executed, a scan or copy function of the image forming system 200A may be executed. On the other hand, if a sheet stays in the image forming apparatus 201A or the post-processing apparatus 202A due to paper jam or the like, the initial setting mode described above may not be executed. Note that, in a configuration in which a plurality of forming striking-out units 2 are driven by independent motors and in a configuration in which a plurality of binding devices 100A are provided, the initial setting mode described above may be executed simultaneously or may be executed at different timings among the devices having different driving sources. When a plurality of binding devices execute the initial setting mode described above at the same time, the time required for initial setting can be shortened, as compared with a case where the initial setting mode is executed at different timings. When a plurality of binding devices execute the initial setting mode described above at different timings, a current peak required instantaneously can be suppressed, as compared with a case where the initial setting mode is executed at the same time.

<Other Examples of Embodiment of Actuation Unit>

Figure 21A:
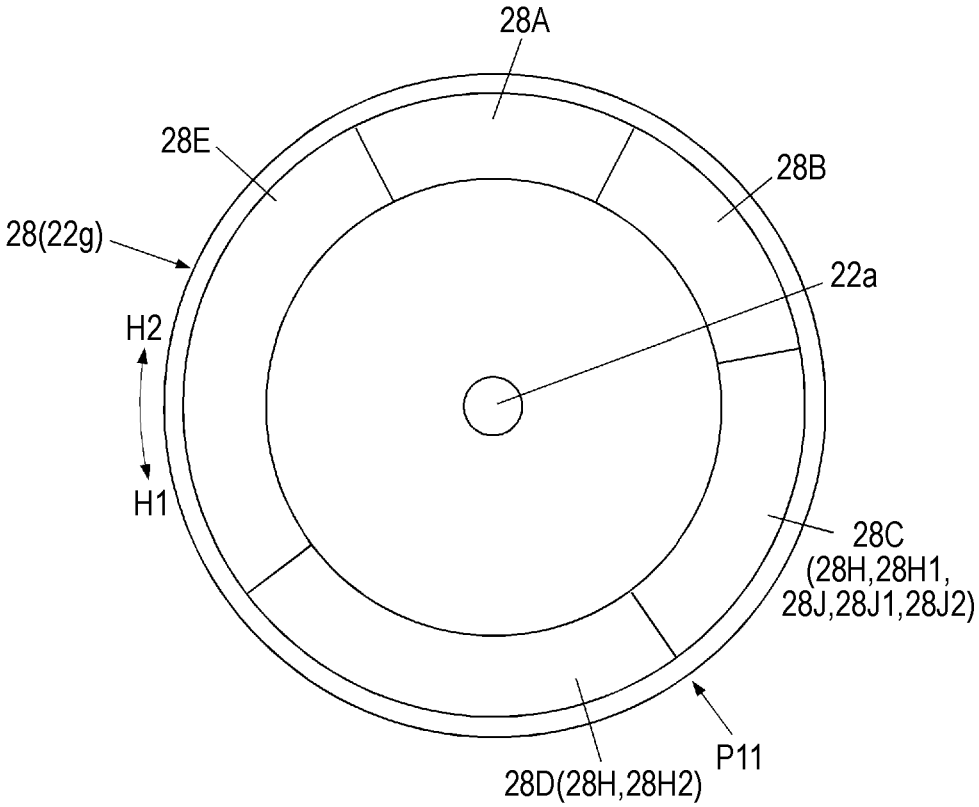
FIG. 21A is a schematic view showing another example of an embodiment of an actuating unit.
Figure 21B:
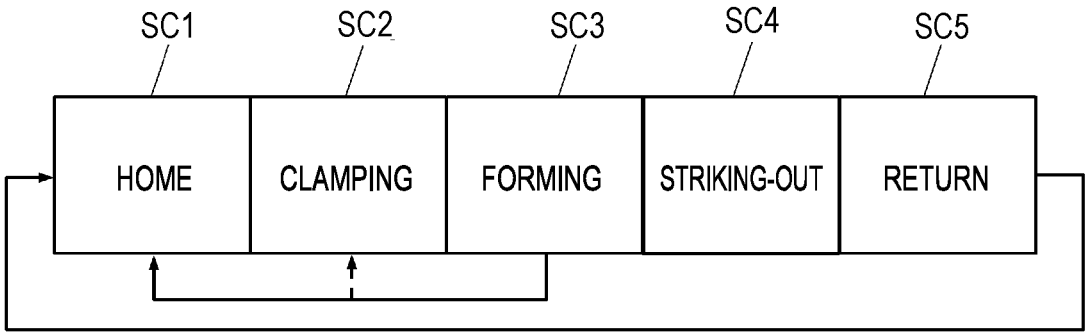
FIG. 21B is an operation illustrating view showing an example of a flow of the striking-out mode and the initial setting mode.

FIG. 21A is a schematic view showing another example of the embodiment of the actuating unit, and FIG. 21B is an operation illustrating view showing an example of a flow of the striking-out mode and the initial setting mode.

In the actuation unit of another embodiment, a cam 28 provided on the gear 22*g* functions as a home region 28A, a clamping region 28B, a forming region 28C, a striking-out region 28D, and a return region 28E along the rotation direction of the gear 22*g* with the shaft 22*a* as a fulcrum.

In the striking-out mode, with the operation in which the cam 28 (gear 22*g*) is rotated in the forward direction denoted with the arrow H1, a standby operation (SC1) at the home position corresponding to the home region 28A, a clamping operation (SC2) corresponding to the clamping region 28B, a forming operation (SC3) corresponding to the forming region 28C, a striking-out operation (SC4) corresponding to the striking-out region 28D, and a return operation (SC5) corresponding to the return region 28E are performed sequentially.

In addition, in the initial setting mode, with the operation in which the cam 28 (gear 22*g*) is rotated to a forward rotation stop position P11 at a predetermined rotational angle in the forward direction denoted with the arrow H1, the standby operation (SC1) at the home position, the clamping operation (SC2) and the forming operation (SC3) are performed sequentially. Further, when it is necessary to perform the forming operation (SC3) multiple times, the cam 28 (gear 22*g*) is rotated at a predetermined rotational angle in the reverse direction denoted with the arrow H2 to return to the home region 28A or the clamping region 28B, and the forming operation (SC3) is performed.

The forming region 28C actuates the staple forming unit 2A as shown in FIGS. 4B, 4C, 5B and 5C and the like by the operation in which the cam 28 is rotated in the forward direction denoted with the arrow H1. In addition, the striking-out region 28D actuates the staple striking-out unit 2B as shown in FIGS. 5B and 5C and the like by the operation in which the cam 28 is rotated in the forward direction denoted with the arrow H1.

The cam 28 has a first cam surface 28H for actuating the staple forming unit 2A and the staple striking-out unit 2B shown in FIGS. 4A to 4G and 5A to 5C, and a second cam surface 28J for actuating the staple forming unit 2A by bypassing all or part of the actuation of the staple striking-out unit 2B by the first cam surface 28H.

The first cam surface 28H has a staple forming cam surface 28H1 for actuating the staple forming unit 2A and a staple striking-out cam surface 28H2 for actuating the staple striking-out unit 2B. In addition, the second cam surface 28J has a staple forming cam surface 28J1 for actuating the staple forming unit 2A and a staple striking-out regulation cam surface 28J2 for bypassing part or all of the staple striking-out cam surface 28H2 described above.

The staple forming cam surface 28H1 is the forming region 28C that performs the forming operation by actuating the staple forming unit 2A, as shown in FIGS. 5B and 5C, and the like, when executing the striking-out mode in which the cam 28 is rotated in the forward direction denoted with the arrow H1. In addition, the staple striking-out cam surface 28H2 is the striking-out region 28D that performs the striking-out operation by actuating the staple striking-out unit 2B, as shown in FIGS. 5B and 5C and the like, when executing the striking-out mode in which the cam 28 is rotated in the forward direction denoted with the arrow H1.

The staple forming cam face 28J1 is the forming region 28C that performs the forming operation by actuating the staple forming unit 2A, as shown in FIGS. 4B and 4C, and the like, when executing the initial setting mode in which the cam 28 is rotated to the forward rotation stop position P11 at a predetermined rotational angle in the forward direction denoted with the arrow H1. In addition, the staple striking-out regulation cam surface 28J2 is the forming region 28C at the time when the cam 28 is rotated at a predetermined rotational angle in the reverse direction denoted with the arrow H2, thereby bypassing the striking-out region 28D and returning to the home region 28A or the clamping region 28B, when executing the initial setting operation.

Note that in stopping the rotation of the motor that drives the cam 28 (gear 22*g*) in the initial setting mode, when the stop position passes the forward rotation stop position P11, the striking-out operation is started. Therefore, a stop region may be provided between the forming region 28C and the striking-out region 28D, and the rotation of the motor may be stopped in the stop region. In this configuration, the staple striking-out regulation cam surface 28J2 is the stop region.

Figure 22A:
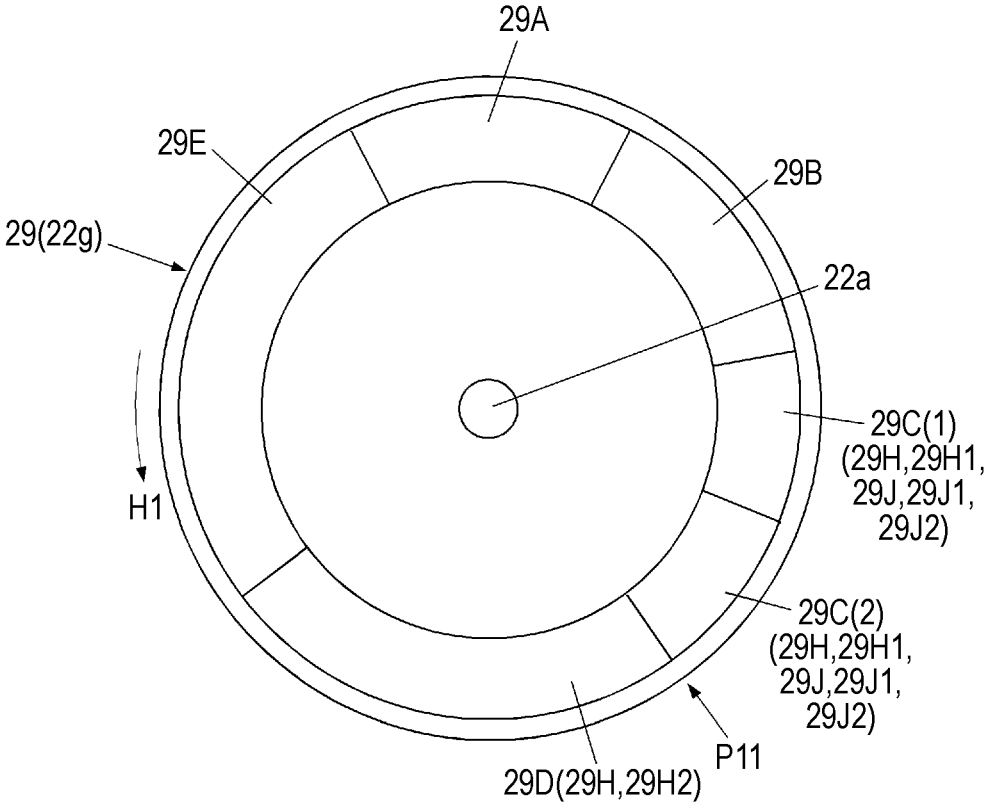
FIG. 22A is a schematic view showing another example of the embodiment of the actuating unit.
Figure 22B:
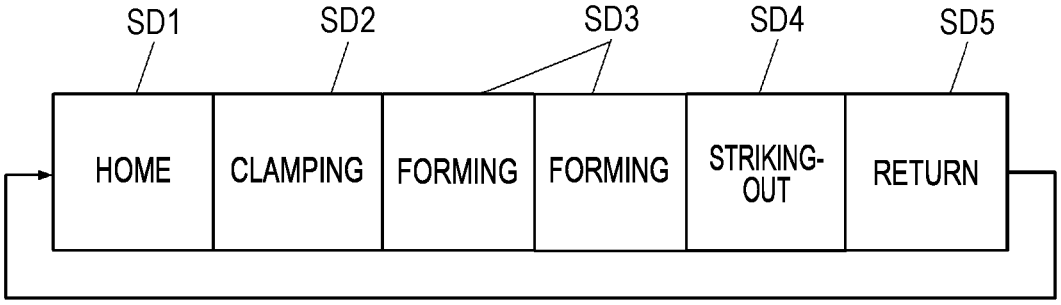
FIG. 22B is an operation illustrating view showing an example of the flow of the striking-out mode and the initial setting mode.

FIG. 22A is a schematic view showing another example of the embodiment of the actuating unit, and FIG. 22B is an operation illustrating view showing an example of a flow of the striking-out mode and the initial setting mode.

In the actuation unit of still another embodiment, a cam 29 provided on the gear 22*g* functions as a home region 29A, a clamping region 29B, a plurality of forming regions 29C(1) to 29C(n), a striking-out region 29D, and a return region 29E along the rotation direction of the gear 22*g* with the shaft 22*a* as a fulcrum.

In the striking-out mode, with the operation in which the cam 29 (gear 22*g*) is rotated in the forward direction denoted with the arrow H1, a standby operation (SD1) at the home position corresponding to the home region 29A, a clamping operation (SD2) corresponding to the clamping region 29B, a forming operation (SD3) corresponding to the plurality of forming regions 29C(1) to 29C(n), a striking-out operation (SD4) corresponding to the striking-out region 29D, and a return operation (SD5) corresponding to the return region 29E are performed sequentially.

In addition, in the initial setting mode, with the operation in which the cam 29 (gear 22*g*) is rotated in the forward direction denoted with the arrow H1, a standby operation (SD1) at the home position corresponding to the home region 29A, a clamping operation (SD2) corresponding to the clamping region 29B, and a forming operation corresponding to the plurality of forming regions 29C(1) to 29C(n) are performed sequentially. Further, when performing the striking-out mode after the initial setting mode, with the operation in which the cam 29 (gear 22*g*) is rotated in the forward direction denoted with the arrow H1, a striking-out operation (SD4) corresponding to the striking-out region 29D and a return operation (SD5) corresponding to the return region 29E are performed sequentially.

The forming regions 29C(1) to 29C(n) actuate the staple forming unit 2A as shown in FIGS. 4B, 4C, 5B and 5C and the like by the operation in which the cam 29 is rotated in the forward direction denoted with the arrow H1. In addition, the striking-out region 29D actuates the staple striking-out unit 2B as shown in FIGS. 5B and 5C and the like by the operation in which the cam 29 is rotated in the forward direction denoted with the arrow H1.

The cam 29 has a first cam surface 29H for actuating the staple forming unit 2A and the staple striking-out unit 2B shown in FIGS. 4A to 4G and 5A to 5C, and a second cam surface 29J for actuating the staple forming unit 2A by bypassing all or part of the actuation of the staple striking-out unit 2B by the first cam surface 29H.

The first cam surface 29H has a staple forming cam surface 29H1 for actuating the staple forming unit 2A and a staple striking-out cam surface 29H2 for actuating the staple striking-out unit 2B. In addition, the second cam surface 29J has a staple forming cam surface 29J1 for actuating the staple forming unit 2A and a staple striking-out regulation cam surface 29J2 for bypassing part or all of the staple striking-out cam surface 29H2 described above.

The staple forming cam surface 29H1 is the forming regions 29C(1) to 29C(n) that perform the forming operation by actuating the staple forming unit 2A, as shown in FIGS. 5B and 5C, and the like, when executing the striking-out mode in which the cam 29 is rotated in the forward direction denoted with the arrow H1. In addition, the staple striking-out cam surface 29H2 is the striking-out region 29D that performs the striking-out operation by actuating the staple striking-out unit 2B, as shown in FIGS. 5B and 5C and the like, when executing the striking-out mode in which the cam 29 is rotated in the forward direction denoted with the arrow H1.

The staple forming cam face 29J1 is the forming region 29C(1) to 29C(n) that perform the forming operation by actuating the staple forming unit 2A, as shown in FIGS. 4B and 4C, and the like, when executing the initial setting mode in which the cam 29 is rotated to the forward rotation stop position P11 at a predetermined rotational angle in the forward direction denoted with the arrow H1. In addition, the staple striking-out regulation cam surface 29J2 is the forming region 29C(1) to 29C(n) that perform the forming operation by actuating the staple forming unit 2A, as shown in FIGS. 4B and 4C, and the like, in a state in which the actuation of the staple striking-out unit 2B by the striking-out region 29D is not started by regulating the rotational angle of the cam 29 in the forward direction denoted with the arrow H1 when executing the initial setting mode, as shown in FIGS. 4B and 4C and the like, i.e., the striking-out region 29D is bypassed by not using the striking-out region 29D.

<Another Embodiment of Binding Device>

Figure 23:
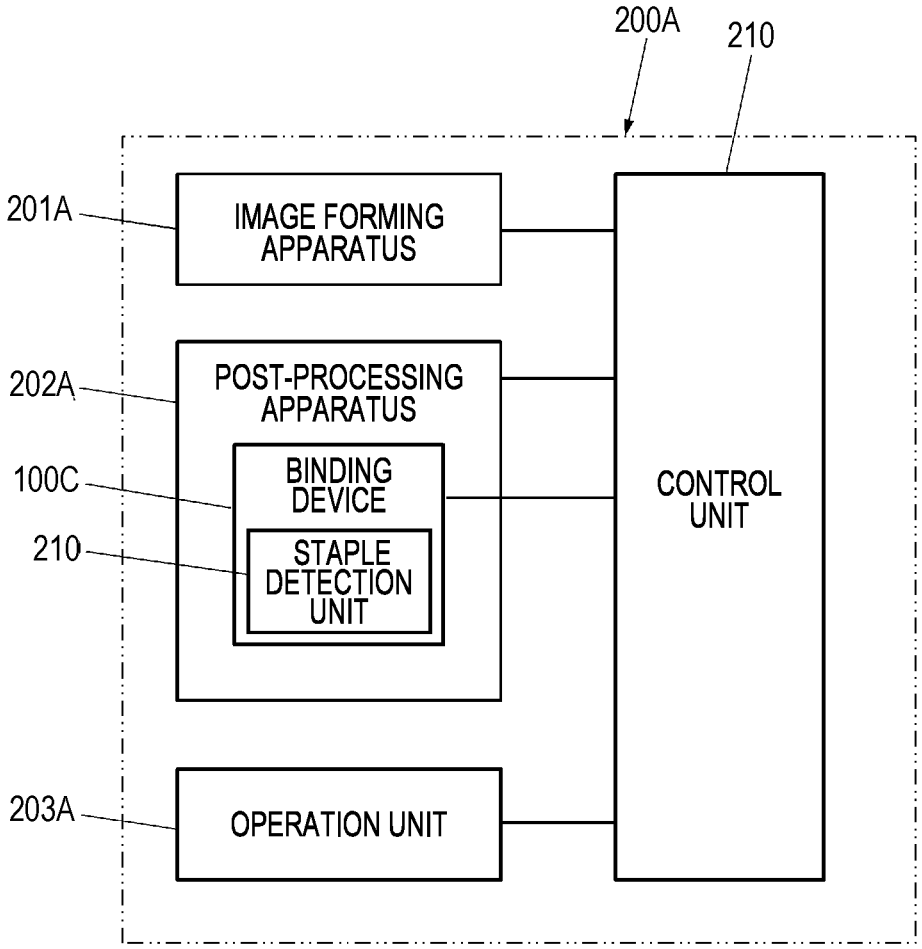
FIG. 23 is a block diagram showing an example of an embodiment of the image forming system and post-processing apparatus having a binding device according to still another embodiment.

FIG. 23 is a block diagram showing an example of the image forming system and post-processing apparatus having a binding device of still another embodiment. FIGS. 24A, 24B, 24C, 24D, and 24E illustrate the second mode in which the staple initial setting processing of repeating multiple times the staple forming process without undergoing the staple striking-out process is executed in a binding device 100C of still another embodiment. In addition, FIG. 25 is a flowchart showing an example of an operation of the image forming system and post-processing apparatus having the binding device according to still another embodiment.

A binding device 100C includes a staple detection unit 211 that detects whether the staple 10 is present at the striking-out position P2. The staple detection unit 211 is configured by a non-contact type sensor such as an optical sensor, a contact type sensor, or the like. The control unit 210 executes the staple initial setting processing of repeating the staple forming process multiple times without undergoing the striking-out process until the staple detection unit 211 detects that the staple 10 is present at the striking-out position P2.

Figure 24A:
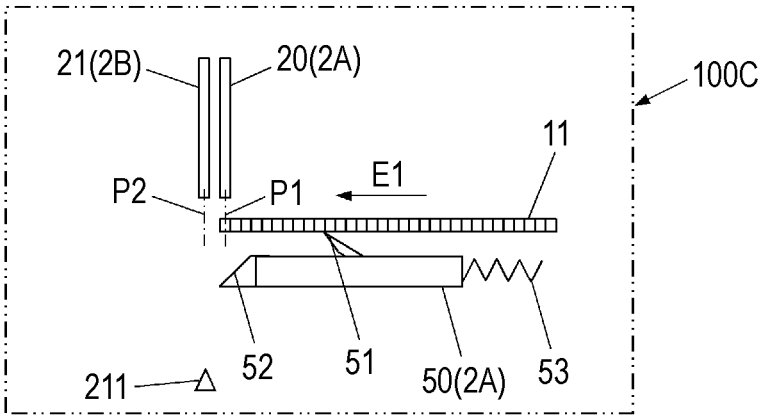
FIG. 24A illustrates an example of an operation of the image forming system and post-processing apparatus having the binding device according to still another embodiment.
Figure 24B:
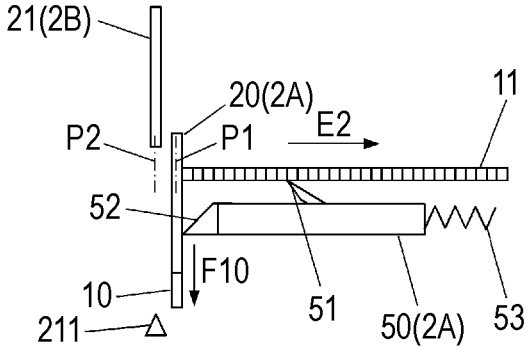
FIG. 24B illustrates the example of the operation of the image forming system and post-processing apparatus having the binding device according to still another embodiment.
Figure 25:
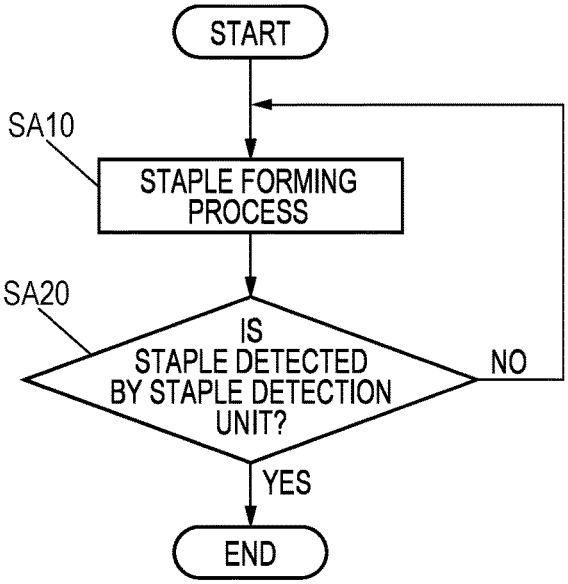
FIG. 25 is a flowchart showing an example of an operation of the image forming system and post-processing apparatus having the binding device according to still another embodiment.

FIG. 24A shows a standby state in which the staple initial setting processing has not been completed and the forming plate 20 and the driver plate 21 have been moved to their respective standby positions. In order to execute the staple forming process in step SB10 of FIG. without undergoing the staple striking-out process, the control unit 210 sets a predetermined state of regulating actuation of the forming plate 21 or regulating an amount of actuation, and moves the forming plate 20 in the direction of the arrow F10, as shown in FIG. 24B. Thereby, the staple 10 at the forming position P1 is formed.

In addition, as the link portion 52 is pushed by the forming plate 20 in the operation in which the forming plate 20 is moved in the direction of the arrow F10 for forming the staple 10, the staple feeding unit 50 is moved in the direction of the arrow E2 while compressing the spring 53.

Figure 24C:
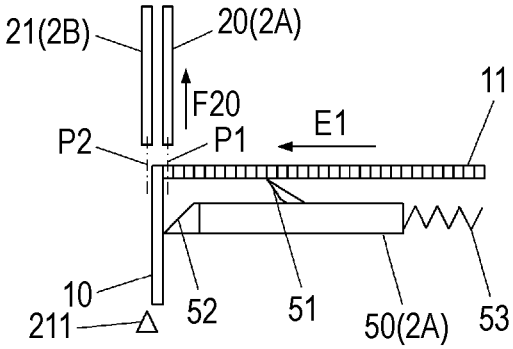
FIG. 24C illustrates the example of the operation of the image forming system and post-processing apparatus having the binding device according to still another embodiment.

After moving the forming plate 20 in the direction of the arrow F10, as shown in FIG. 24C, the forming plate 20 is moved in the direction of the arrow F20. In an operation in which the forming plate 20 is moved in the direction of the arrow F20 away from the formed staple 10, the link portion 52 is released from being pushed by the forming plate 20, so that the staple feeding unit 50 is moved in the direction of the arrow E1 by the force of the spring 53. Thereby, the staple 10 is fed in the direction of the arrow E1 toward the striking-out position P2. The first staple forming process is executed by the above operations in FIGS. 24B and 24C.

In step SB20 of FIG. 25, the control unit 210 determines whether to end the staple forming process when the staple detection unit 211 detects that the staple 10 is present at the striking-out position P2.

Figure 24D:
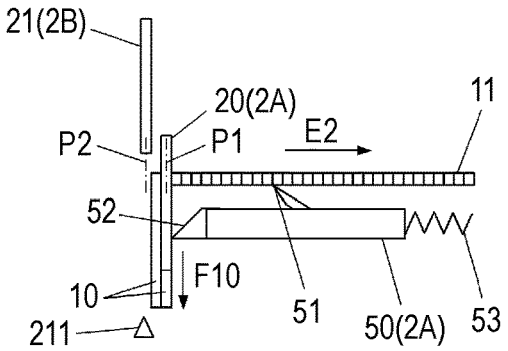
FIG. 24D illustrates the example of the operation of the image forming system and post-processing apparatus having the binding device according to still another embodiment.

If the control unit 210 determines that there is no staple 10 at the striking-out position P2 and the staple forming process is not to be ended, in order to execute the staple forming process in step SB10 of FIG. 25 without undergoing the staple striking-out process, the control unit 210 sets a predetermined state of regulating actuation of the driver plate 21 or regulating an amount of actuation, and moves the forming plate 20 in the direction of the arrow F10, as shown in FIG. 24D. Thereby, the next staple 10 moved to the staple forming position P1 in the previous staple forming process is formed.

Figure 24E:
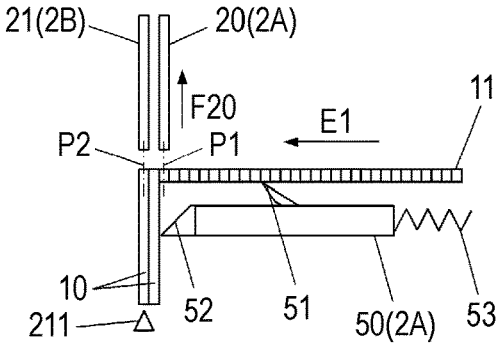
FIG. 24E illustrates the example of the operation of the image forming system and post-processing apparatus having the binding device according to still another embodiment.

After moving the forming plate 20 in the direction of the arrow F10, as shown in FIG. 24E, the forming plate 20 is moved in the direction of the arrow F20. Thereby, the staple 10 is fed in the direction of the arrow E1 toward the striking-out position P2. The second staple forming process is executed by the above operations in FIGS. 24D and 24E.

In the present example, in the second staple forming process, the staple 10 formed in the staple forming process is moved to the striking-out position P2. For this reason, in step SB20 of FIG. 25, the staple detection unit 211 detects that the staple 10 is present at the striking-out position P2, and the control unit 210 ends the staple forming process. In the binding device 100C, in the case of the configuration where the staple 10 formed in the second staple forming process is moved to the striking-out position P2, the staple forming process can be ended without executing the third and subsequent staple forming processes, and the number of reciprocating operations of the forming plate 20 in the staple forming process can be suppressed to the minimum. Further, an idle striking mark due to idle striking is not left on the sheet. In the binding device 100B having the two forming striking-out units 2, each of the forming striking-out units 2 is configured to have the staple detection unit 211. Thereby, until each staple detection unit 211 of both the forming striking-out units 2 detects the staple 10, each of the forming striking-out units 2 is driven with the single motor 201, so that the initial setting for the staple 10 can be performed with the minimum number of times by both the forming striking-out units 2. Further, an idle striking mark due to idle striking is not left on the sheet.

What is claimed is:

1. An image forming system comprising:

an image forming apparatus configured to form an image on a sheet;

a post-processing apparatus comprising a binding device configured to bind the sheet output from the image forming apparatus; and a control unit configured to control the binding device, wherein the binding device is capable of executing binding processing via a staple forming process of forming a staple and moving the staple toward a striking-out position and a staple striking-out process of striking out the staple at the striking-out position, and wherein the control unit is configured to control the binding device to repeat multiple times the staple forming process without undergoing the staple striking-out process.

2. The image forming system according to claim 1, wherein the control unit is configured to control the binding device so as to be able to switch:

a first mode in which the binding processing is executed via the staple forming process and the staple striking-out process, and a second mode in which staple initial setting processing of repeating multiple times the staple forming process without undergoing the staple striking-out process is executed.

3. The image forming system according to claim 2, wherein the binding device comprises: a staple forming unit configured to form a staple and moving the staple toward the striking-out position in the staple forming process, a staple striking-out unit configured to strike out the staple at the striking-out position in the staple striking-out process, and a displaceable actuation unit, the staple forming unit or the staple striking-out unit being configured to be actuated according to a displacement direction and a displacement amount of the actuation unit, and wherein the control unit is configured to control the displacement direction and displacement amount of the actuation unit to switch a number of actuations of the staple forming unit and presence or absence of actuation of the staple striking-out unit.

4. The image forming system according to claim 3, wherein the binding device comprises a plurality of the staple forming units, a plurality of the staple striking-out units, a plurality of the actuation units, and a single motor configured to drive the plurality of actuation units, and wherein the control unit is configured to control the actuation unit via the motor.

5. A post-processing apparatus comprising:

a binding device configured to bind a sheet output from an image forming apparatus configured to form an image on the sheet; and a control unit configured to control the binding device, wherein the binding device is capable of executing binding processing via a staple forming process of forming a staple and moving the staple toward a striking-out position and a staple striking-out process of striking out the staple at the striking-out position, and wherein the control unit is configured to control the binding device to repeat multiple times the staple forming process without undergoing the staple striking-out process.

6. The post-processing apparatus according to claim 5, wherein the binding device comprises: a staple forming unit configured to form a staple and moving the staple toward the striking-out position in the staple forming process, a staple striking-out unit configured to strike out the staple at the striking-out position in the staple striking-out process, and a displaceable actuation unit, wherein the staple forming unit or the staple striking-out unit is configured to be actuated according to a displacement direction and a displacement amount of the actuation unit, and wherein the control unit is configured to control the displacement direction and displacement amount of the actuation unit to switch a number of actuations of the staple forming unit and presence or absence of actuation of the staple striking-out unit.

7. The post-processing apparatus according to claim 6, wherein the binding device comprises a plurality of the staple forming units, a plurality of the staple striking-out units, a plurality of the actuation units, and a single motor configured to drive the plurality of actuation units, and wherein the control unit is configured to control the actuation unit via the motor.

8. A binding device comprising:

a staple forming unit configured to form a staple and to move the staple toward a striking-out position;

a staple striking-out unit configured to strike out the staple at the striking-out position; and a cam configured to actuate the staple forming unit and the staple striking-out unit, wherein the cam has a first cam surface for actuating the staple forming unit and the staple striking-out unit, and a second cam surface for actuating the staple forming unit by bypassing all or part of actuation of the staple striking-out unit by the first cam surface.

9. The binding device according to claim 8, wherein the first cam surface has a staple forming cam surface for actuating the staple forming unit, and a staple striking-out cam surface for actuating the staple striking-out unit, and wherein the second cam surface has a staple forming cam surface for actuating the staple forming unit, and a staple striking-out regulation cam surface for bypassing part or all of the staple striking-out cam surface.

10. The binding device according to claim 9, wherein the cam is a rotation-type cam configured to rotate with a shaft as a fulcrum and having the first and second cam surfaces formed in a circumferential direction, wherein the staple forming cam surface is formed on one surface in an axial direction of the cam, and wherein the staple striking-out cam surface and the staple striking-out regulation cam surface are formed on the other surface in the axial direction.

11. The binding device according to claim 10, wherein the staple forming cam surface is formed in a region that partially or fully overlaps the staple striking-out cam surface and the staple striking-out regulation cam surface along a rotation direction of the cam.

12. The binding device according to claim 11, wherein the staple striking-out unit comprises a driver follower in contact with the staple striking-out regulation cam surface, and wherein the second cam surface comprises a regulation portion configured to regulate movement of the driver follower from the staple striking-out regulation cam surface toward the staple striking-out cam surface.

13. The binding device according to claim 8, further comprising:

a plurality of the staple forming units each configured to form a staple and to move the staple toward a striking-out position;

a plurality of the staple striking-out units each configured to strike out the staple at the striking-out position;

a plurality of the cams configured to actuate the plurality of staple forming units and the plurality of staple striking-out units, and a single motor configured to drive the cams.

* * * * *